United States Patent [19]

Morigaki et al.

[11] Patent Number: 4,704,350

[45] Date of Patent: Nov. 3, 1987

[54] SILVER HALIDE COLOR PHOTOGRAPHIC MATERIAL

[75] Inventors: Masakazu Morigaki; Nobutaka Ohki; Osamu Takahashi; Hideaki Naruse, all of Kanagawa, Japan

[73] Assignee: Fuji Photo Film Co., Ltd., Kanagawa, Japan

[21] Appl. No.: 947,305

[22] Filed: Dec. 29, 1986

[30] Foreign Application Priority Data

Dec. 25, 1985 [JP] Japan ..... 60-295467
Feb. 20, 1986 [JP] Japan ..... 61-36416

[51] Int. Cl.[4] ..... G03C 7/38
[52] U.S. Cl. ..... 430/546; 430/558; 430/551; 430/505; 430/611
[58] Field of Search ..... 430/558, 551, 505, 611, 430/546

[56] References Cited

U.S. PATENT DOCUMENTS

| | | | |
|---|---|---|---|
| 4,021,248 | 5/1977 | Shiba et al. | 430/551 |
| 4,604,339 | 8/1986 | Sugimoto et al. | 430/611 |
| 4,614,702 | 9/1986 | Sawada et al. | 430/611 |
| 4,639,413 | 1/1987 | Kawagishi et al. | 430/505 |

FOREIGN PATENT DOCUMENTS 60-21048 8/1985 Japan .

*Primary Examiner*—Richard L. Schilling
*Assistant Examiner*—Patrick Doody
*Attorney, Agent, or Firm*—Sughrue, Mion, Zinn, Macpeak & Seas

[57] ABSTRACT

A silver halide color photographic material is disclosed, comprising a support having provided thereon at least one silver halide emulsion layer having dispersed therein lipophilic fine particles containing a certain type of lipophilic pyrazoloazole coupler, and said lipophilic fine particles further contain at least one lipophilic mercapto compound represented by formula (II)

$$R—SH \qquad (II)$$

wherein R represents a substituted or unsubstituted alkyl, alkenyl, or aryl group, and said compound of formula (II) has a water solubility of not more than 1% by weight at 25° C.

The material is prevented from forming color stain caused by processing solution components that become incorporated into the materials during development processing.

13 Claims, No Drawings

SILVER HALIDE COLOR PHOTOGRAPHIC MATERIAL

FIELD OF THE INVENTION

This invention relates to a silver halide color photographic material containing a pyrazoloazole magenta coupler. More particularly, it relates to a technique for preventing stains formed during development processing of light-sensitive materials containing pyrazoloazole magenta couplers.

BACKGROUND OF THE INVENTION

Silver halide color photographic materials generally comprise multiple silver halide emulsion layers, each of which is sensitive to one of the three primary colors, i.e., blue, green or red, respectively, wherein the respective layer develops a yellow, magenta or cyan color to reproduce a color image according to a subtractive color process. Therefore, the image quality of the reproduced color image greatly depends on the color sensitivity characteristics of each layer and the spectral absorption characteristics of the developed hue. In general, these characteristics have not completely reached the desired height of theoretical perfection because of limitations of color developability of the compounds used.

In the reproduction of colors, the developed hue of magenta couplers is particularly important, and various improved magenta couplers have been proposed. Among them, pyrazoloazole magenta couplers are especially excellent in spectral absorption characteristics of the developed hue. In an attempt to improve the developed hue of 5-pyrazolone magenta couplers, anilino type couplers having superior spectral absorption characteristics to those of ureido or acylamino type couplers were developed, as disclosed in Japanese Patent Application (OPI) Nos. 74027/74 and 111631/74 (the term "OPI" as used herein refers to a "published unexamined Japanese patent application").

Further, pyrazoloazole magenta couplers having reduced side absorptions have been developed as described, e.g., in U.S. Pat. Nos. 3,725,067, 3,369,897, 4,500,630, 3,061,432 and 4,540,654, and Japanese Patent Application (OPI) Nos. 33552/85, 43659/85, 162548/84, 43659/85, 171956/84, 172982/85 and 33552/85, and Japanese Patent Publication No. 27411/72. The dye images obtained from these couplers have reduced undesired absorptions in the blue and red light regions, securing an advantage in color reproduction over those obtained from 5-pyrazolone magenta couplers. In addition, the images undergo little yellowing, probably because the couplers per se are less decomposable with respect to light, heat and humidity.

The inventors previously studied pyrazoloazole magenta couplers possessing the above-described advantages, and, as a result, have found that pyrazoloazole magenta couplers represented by formula (I) hereinafter described provide particularly excellent hues. However, these couplers still have a disadvantage of stain formation (color stain on unexposed areas) during development processing, though some improvement could be seen.

The stain includes yellow stain mainly due to decomposition of magenta couplers, and color stain caused by processing solution components that become incorporated into light-sensitive materials during development processing. The stain of concern in the present invention is the color stain due to remaining processing components.

As color photographic images are usually stored as records for a long period of time or put on exhibition, stain formation is a fatal defect of such recording materials. Conventionally known methods of stain prevention include incorporation of reducing agents to light-sensitive materials. Known reducing agents for this purpose include hydroquinones as disclosed in U.S. Pat. Nos. 3,935,016 and 3,960,570; chromans and coumarans as described in U.S. Pat. No. 2,360,290; phenols as described in Japanese Patent Application (OPI) No. 9449/76; amino compounds, such as aminophenols and anilines, as described in U.S. Pat. Nos. 4,463,085 and 4,483,918; and the like.

However, combinations of the couplers represented by formula (I) according to the present invention with these known reducing agents failed to sufficiently prevent stain formation with development.

Japanese Patent Application (OPI) No. 21048/85 teaches combinations of 5-pyrazolone magenta couplers and mercapto compounds, but its purpose resides in prevention of yellow stain, essentially differing from the objects of this invention hereinafter described.

SUMMARY OF THE INVENTION

One obect of this invention is to prevent magenta stain resulting from development processing of light-sensitive materials containing the pyrazoloazole magenta couplers represented by formula (I) hereinafter described, and, more particularly, to prevent magenta stain caused by incorporation of processing solution components into the light-sensitive materials during development processing.

Another object of this invention is to provide a silver halide color photographic material excellent in color reproducibility and development processability.

It has now been found that these objects can be effectively accomplished by a silver halide color photographic material comprising a support having provided thereon at least one silver halide emulsion layer having dispersed therein lipophilic fine particles containing a lipophilic pyrazoloazole coupler represented by formula (I) shown below, wherein said lipophilic fine particles further contain at least one lipophilic mercapto compound represented by formula (II) shown below having a water solubility of not more than 1% by weight at 25° C.

Formula (I) is represented by

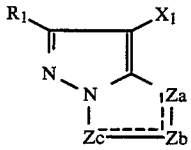

(I)

wherein $R_1$ represents a hydrogen atom or a substituent; $X_1$ represents a hydrogen atom or a group releasable upon coupling with an oxidation product of an aromatic primary amine developing agent; Za, Zb and Zc each represents a methine group, a substituted methine group, =N—, or —NH—; either one of the Za—Zb bond and Zb—Zc bond is a double bond, with the other being a single bond; and a carbon-carbon double bond as represented by Zb—Zc may be a part of an aromatic condensed with the N-containing ring; and $R_1$, $X_1$ or the substituted methine group as represented by Za, Zb or Zc may form a polymer.

Formula (II) is represented by $$R—SH \quad (II)$$

wherein R represents a substituted or unsubstituted alkyl group, a substituted or unsubstituted alkenyl group or a substituted or unsubstituted aryl group.

DETAILED DESCRIPTION OF THE INVENTION

The term "polymer" as used in the definition of formula (I) means compounds having at least two groups represented by formula (I) per molecule and embraces bis compounds and polymeric couplers. The polymeric coupler may be a homopolymer solely comprising a monomer having the moiety represented by formula (I), and preferably a monomer containing a vinyl group (hereinafter referred to as "vinyl monomer") or a copolymer comprising such a monomer and a non-color-forming ethylenically unsaturated monomer which is incapable of coupling with an oxidation product of an aromatic primary amine developing agent.

The compounds of formula (I) are 5-membered ring condensed nitrogen-containing heterocyclic couplers. The color-forming nucleus exhibits aromaticity isoelectronic to naphthalene, and has a chemical structure usually called azapentalene. Of the compounds represented by formula (I), preferred are 1H-imidazo[1,2-b]pyrazoles of the following formula (I-a), 1H-pyrazolo[5,1-c][1,2,4]triazoles of the following formula (I-b), 1H-pyrazolo[1,5-b]pyrazoles of the following formula (I-c), 1H-pyrazolo[1,5-b][1,2,4]triazoles of the following formula (I-d), 1H-pyrazolo[1,5-d]tetrazoles of the following formula (I-e), and 1-pyrazolo[1,5-a]benzimidazoles of the following formula (I-f).

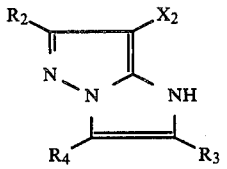
(I-a)

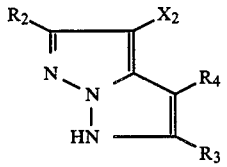
(I-b)

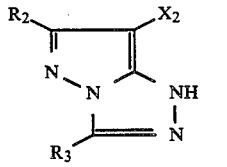
(I-c)

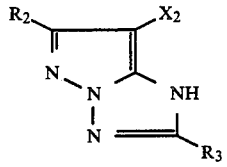
(I-d)

-continued

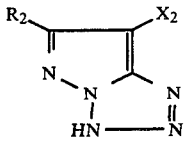
(I-e)

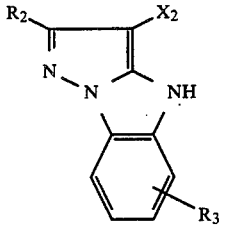
(I-f)

In formulae (I-a) to (I-f), $R_2$, $R_3$ and $R_4$ each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group; and $X_2$ represents a hydrogen atom, a halogen atom, a carboxyl group, or a group bonded to the coupling carbon atom via an oxygen atom, a nitrogen atom, or a sulfur atom and is releasable upon coupling.

$R_2$, $R_3$, $R_4$ or $X_2$ may be a divalent group, at which a bis compound is formed. When the moiety represented by formula (I-a), (I-b), (I-c), (I-d), (I-e) or (I-f) is contained in a vinyl monomer, $R_2$, $R_3$ or $R_4$ represents a single bond or a linking group, via which the moiety of (I-a), (I-b), (I-c), (I-d), (I-e) or (I-f) and the vinyl group are bonded.

More specifically, $R_2$, $R_3$ and $R_4$ each represents a hydrogen atom, a halogen atom (e.g., a chlorine atom, a bromide atom, etc.), an alkyl group (e.g., a methyl group, a propyl group, a t-butyl group, a trifluoromethyl group, a tridecyl group, a 3-(2,4-di-t-amylphenoxy)propyl group, a 2-dodecyloxyethyl group, a 3-phenoxypropyl group, a 2-hexylsulfonylethyl group, a cyclopentyl group, a benzyl group, etc.), an aryl group (e.g., a phenyl group, a 4-t-butylphenyl group, a 2,4-di-t-amylphenyl group, a 4-tetradecanamidophenyl group, etc.), a heterocyclic group (e.g., a 2-furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a 2-methanesulfonylethoxy group, etc.), an aryloxy group (e.g., a phenoxy group, a 2-methylphenoxy group, a 4-t-butylphenoxy group, etc.), a heterocyclic oxy group (e.g., a 2-benzimidazolyloxy group, etc.), an acyloxy group (e.g., an acetoxy group, a hexadecanoyloxy group, etc.), a carbamoyloxy group (e.g., an N-phenylcarbamoyloxy group, an N-ethylcarbamoyloxy group, etc.), a silyloxy group (e.g., a trimethylsilyloxy group, etc.), a sulfonyloxy group (e.g., a dodecylsulfonyloxy group, etc.), an acylamino group (e.g., an acetamido group, a benazmido group, a tetradecanamido group, an α-(2,4-di-t-amylphenoxy)butyramido group, a γ-(3-t-butyl-4-hydroxyphenoxy)butyramido group, an α-[4-(4-hydroxyphenylsulfonyl)phenoxy]decanamido group, etc.), an anilino group (e.g., a phenylamino group, a 2-chloroanilino group, a 2-chloro-5-tetradecanamidoanilino group, a 2-chloro-5-dodecyloxycarbonylanilino group, an N-acetylanilino group, a 2-chloro-5-[α-(3-t-butyl-4-hydroxyphenoxy)-dodecanamido]anilino group, etc.), a ureido group (e.g., a phenylureido group, a methylureido group, an N,N-dibutylureido group, etc.), an imido group (e.g., an N-succinimido group, a 3-benzylhydantoinyl group, a 4-(2-ethylhexanoylamino)phthalimido group, etc.), a sulfamoylamino group (e.g., an N,N-dipropylsulfamoylamino group, an N-methyl-N-decylsulfamoylamino group, etc.), an alkylthio group (e.g., a methylthio group, an octylthio group, a tetradecylthio group, a 2-phenoxyethylthio group, a 3-phenoxypropylthio group, a 3-(4-t-butylphenoxy)propylthio group, etc.), an arylthio group (e.g., a phenylthio group, a 2-butoxy-5-t-octylphenylthio group, a 3-pentadecylphenylthio group, a 2-carboxyphenylthio group, a 4-tetradecanamidophenylthio group, etc.), a heterocyclic thio group (e.g., a 2-benzothiazolylthio group, etc.), an alkoxycarbonylamino group (e.g., a methoxycarbonylamino group, a tetradecyloxycarbonylamino group, etc.), an aryloxycarbonylamino group (e.g., a phenoxycarbonylamino group, a 2,4-di-t-butylphenoxycarbonylamino group, etc.), a sulfonamido group (e.g., a methanesulfonamido group, a hexadecanesulfonamido group, a benzenesulfonamido group, a p-toluenesulfonamido group, an octadecanesulfonamido group, a 2-methyloxy-5-t-butylbenzenesulfonamido group, etc.), a carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-[3-(2,4-di-t-amylphenoxy)propyl]carbamoyl group, etc.), an acyl group (e.g., an acetyl group, a (2,4-di-t-amylphenoxy)acetyl group, a benzoyl group, etc.), a sulfamoyl group (e.g., an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group, etc.), a sulfonyl group (e.g., a methanesulfonyl group, an octanesulfonyl group, a benzenesulfonyl group, a toluenesulfonyl group, etc.), a sulfinyl group (e.g., an octanesulfinyl group, a dodecylsulfinyl group, a phenylsulfinyl group, etc.), an alkoxycarbonyl group (e.g., a methoxycarbonyl group, a butyloxycarbonyl group, a dodecyloxycarbonyl group, an octadecyloxycarbonyl group, etc.), an aryloxycarbonyl group (e.g., a phenyloxycarbonyl group, or a 3-pentadecyloxycarbonyl group, etc.). $X_2$ represents a hydrogen atom, a halogen atom (e.g., a chlorine atom, a bromine atom, an iodine atom, etc.), a carboxyl group, a group bonded via an oxygen atom (e.g., an acetoxy group, a propanoyloxy group, a benzoyloxy group, a 2,4-dichlorobenzoyloxy group, an ethoxyoxaloyloxy group, a pyruvinyloxy group, a cinnamoyloxy group, a phenoxy group, a 4-cyanophenoxy group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxy group, a 5-phenyltetrazolyloxy group, a 2-benzothiazolyloxy group, etc.), a group bonded via a nitrogen atom (e.g., a benzenesulfonamido group, an N-ethyltoluenesulfonamido group, a heptafluorobutanamido group, a 2,3,4,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo-3-oxazolidinyl group, a 1-benzylethoxy-3-hydantoinyl group, a 2N-1,1-dioxo-3(2H)-oxo-1,2-benzisothiazolyl group, a 2-oxo-1,2-dihydro-1-pyridinyl group, an imidazolyl group, a pyrazolyl group, a 3,5-diethyl-1,2,4-triazol-1-yl group, a 5- or 6-bromobenzotriazol-1-yl group, a 5-methyl-1,2,4-triazol-1-yl group, a benzimidazolyl group, a 3-benzyl-1-hydantoinyl group, a 1-benzyl-5-hexadecyloxy-3-hydantoinyl group, a 5-methyl-1-tetrazolyl group, a 4-methoxyphenylazo group, a 4-pivaloylaminophenylazo group, a 2-hydroxy-4-propanoylphenylazo group, etc.), or a group bonded via a sulfur atom (e.g., a phenylthio group, a 2-carboxyphenylthio group, a 2-methoxy-5-t-octylphenylthio group, a 4-methanesulfonylphenylthio group, a 4-octanesulfonamidophenylthio group, a 2-butoxyphenylthio group, a 2-(2-hexanesulfonylethyl)-5-t-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group, a 2-phenyl-3-dodecyl-1,2,4-triazolyl-5-thio group, etc.).

Examples of divalent groups as represented by $R_2$, $R_3$, $R_4$ or $X_2$ which form a bis compound include a substituted or unsubstituted alkylene group (e.g., a methylene group, an ethylene group, a 1,10-decylene group, $—CH_2CH_2—O—CH_2CH_2—$, etc.), a substituted or unsubstituted phenylene group (e.g., a 1,4-phenylene group, a 1,3-phenylene group,

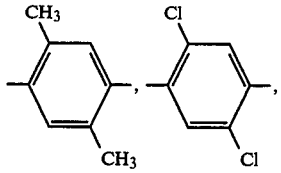

etc.), and $—NHCO—R_5—CONH—$, wherein $R_5$ represents a substituted or unsubstituted alkylene or phenylene group.

When the moiety of formulae (I-a) to (I-f) is contained in the vinyl monomer, the linking group as represented by $R_2$, $R_3$ or $R_4$ include combinations of groups selected from a substituted or unsubstituted alkylene group (e.g., a methylene group, an ethylene group, a 1,10-decylene group, $—CH_2CH_2OCH_2CH_2—$, etc.), a substituted or unsubstituted phenylene group (e.g., a 1,4-phenylene group, a 1,3-phenylene group,

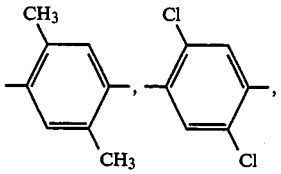

etc.), —NHCO—, —CONH—, —O—, —OCO—, and an aralkylene group

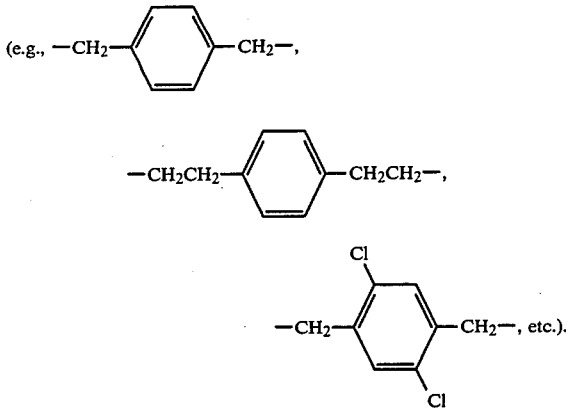

The vinyl group in the vinyl monomer may contain substituents other than those represented by formulae (I-a) to (I-f). Preferred substituents are a hydrogen atom, a chlorine atom, and a lower alkyl group having up to 4 carbon atoms.

The non-color-forming ethylenically unsaturated monomer which is incapable of coupling with an oxidation product of an aromatic primary amine developing agent includes acrylic acid, α-chloroacrylic acid, α-alacrylic acid (e.g., methacrylic acid), and esters or amides derived from those acrylic acids (e.g., acrylamide, n-butyl acrylamide, t-butyl acrylamide, diacetone acrylamide, methacrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate, and β-hydroxy methacrylate), methylenedibisacrylamide, vinyl esters (e.g., vinyl acetate, vinyl propionate, and vinyl laurate,) acrylonitrile, methacrylonitrile, aromatic vinyl compounds (e.g., styrene and derivatives thereof, vinyltoluene, divinylbenzene, vinylacetophenone, and sulfostyrene), itaconic acid, citraconic acid, crotonic acid, vinylidene chloride, vinyl alkyl ethers (e.g., vinyl ethyl ether), maleic acid, maleic anhydride, maleic esters, N-vinyl-2-pyrrolidone, N-vinylpyridine, 2- or 4-vinylpyridine, etc.

These monomers may be used in combinations of two or more thereof.

Of compounds of formlae (I-a) to (I-f), those of formulae (I-a), (I-c) and (I-d) are preferred, and those of formula (I-d) are particularly preferred. Further, it is preferred that at least one of $R_2$ and $R_3$ be a substituted or unsubstituted branched chain alkyl group, i.e., a substituted or unsubstituted alkyl group having a secondary or tertiary carbon atom bonded to the pyrazoloazole skeleton. The secondary carbon atom is a carbon atom having one hydrogen atom directly bonded thereto and preferably further having a substituted or unsubstituted alkyl group bonded thereto, and the tertiary carbon atom is a carbon atom having no hydrogen atom directly bonded thereto and preferably having a substituted or unsubstituted alkyl group bonded thereto. Examples of the substituted alkyl group bonded to the secondary or tertiary carbon atom include a sulfonamidoalkyl group (preferably a sulfonamidoarylsulfonamidoalkyl group), a sulfonamidoarylalkyl group and a sulfonylalkyl group.

The compounds of formula (I-a) are described, e.g., in Japanese Patent Application (OPI) No.162548/84, etc.; the compounds of formula (I-b) are described, e.g., in Japanese Patent Application (OPI) No. 43659/85, etc.; the compounds of formula (I-c) are described, e.g., in Japanese Patent Publication No. 27411/72; the compounds of formula (I-d) are described, e.g., in Japanese Patent Application (OPI) Nos. 171956/84 and 172982/85; the compounds of formula (I-e) are described, e.g., in Japanese Patent Application (OPI) No. 33552/85; and the compounds of formula (I-f) are described, e.g., in U.S. Pat. No. 3,061,432. Methods for synthesizing these compounds are also disclosed in the respective publications.

High color developability-imparting ballast groups described in Japanese Patent Application (OPI) Nos. 42045/83, 214854/84, 177553/84, 177554/84 and 177557/84 may be applied to any and every compound of formulae (I-a) to (I-f).

Specific but non-limiting examples of the pyrazoloazole couplers of formula (I) according to the present invention are shown below:

(I-1)

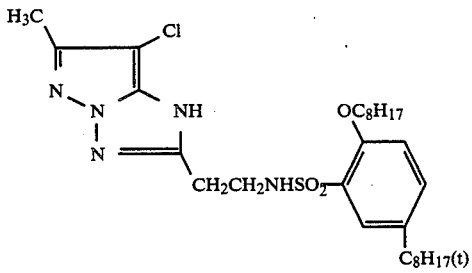

(I-2)

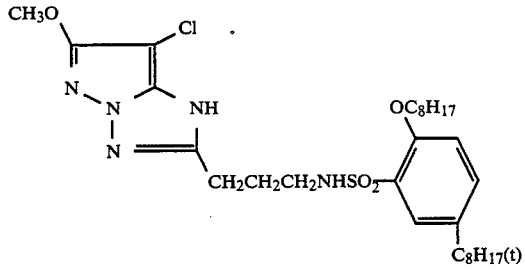

(I-3)

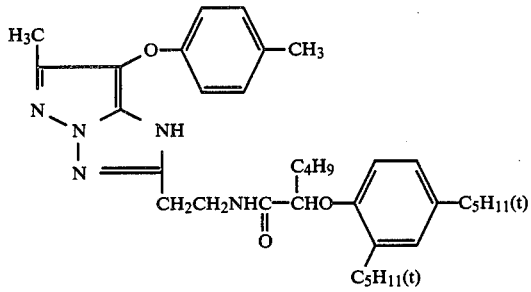

(I-4)

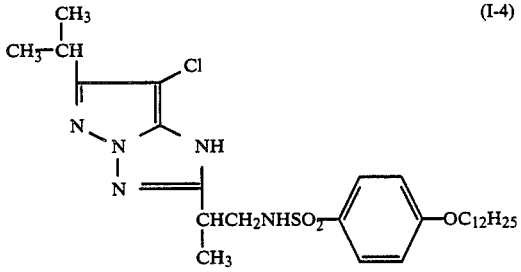

-continued
(I-5)
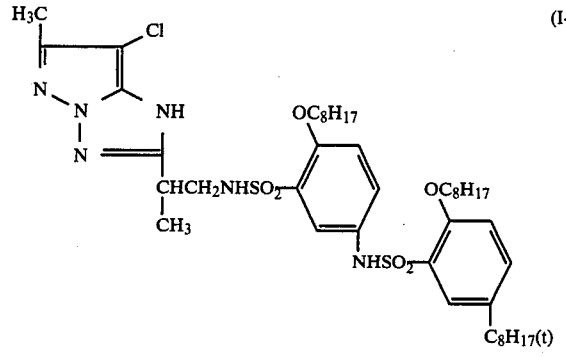
(I-6)
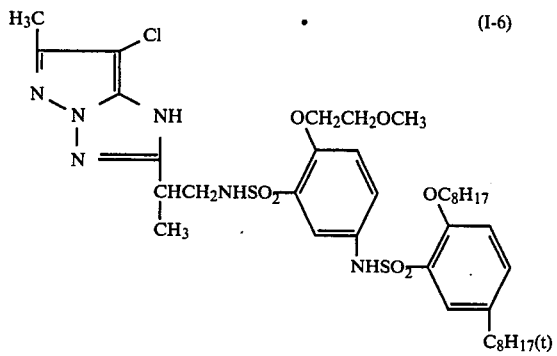
(I-7)
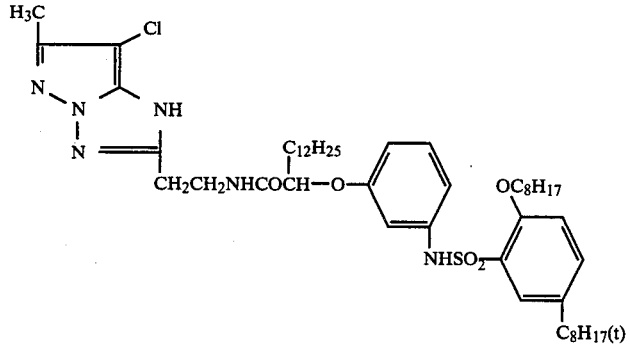
(I-8)
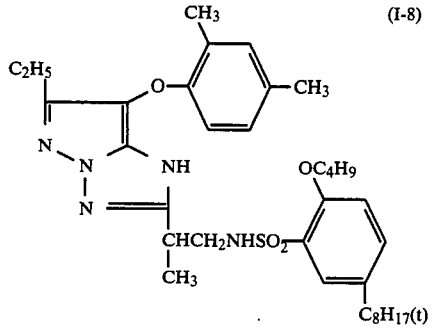
(I-9)
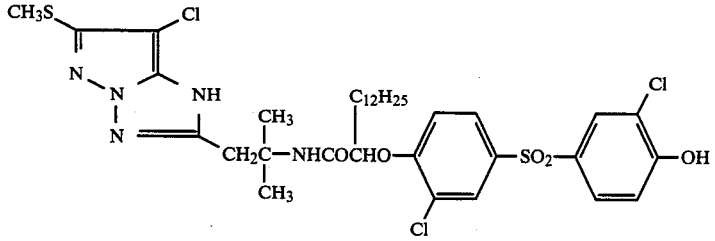
(I-10)
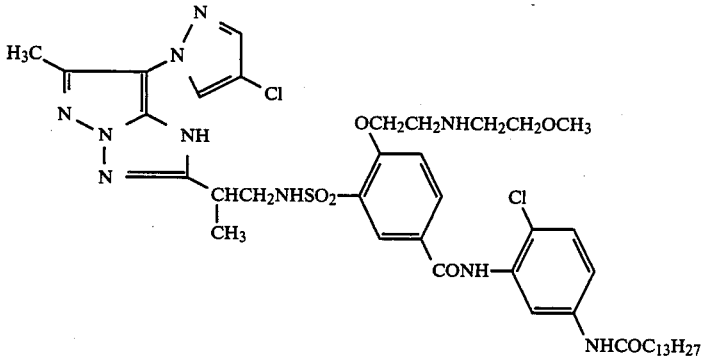
(I-11)
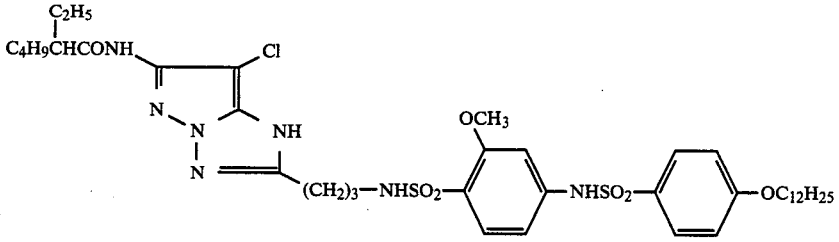

-continued
(I-12)
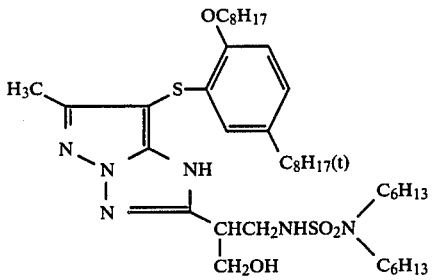
(I-13)
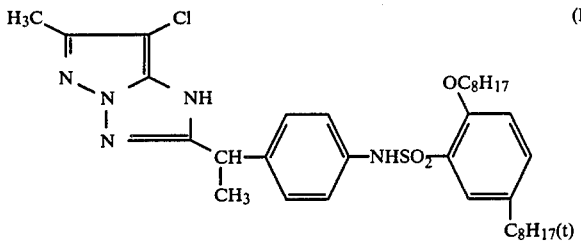
(I-14)
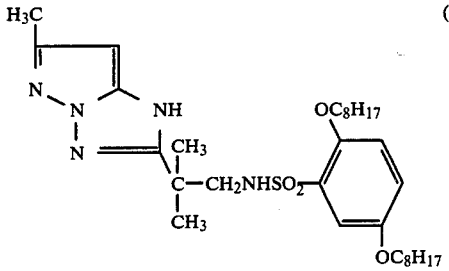
(I-15)
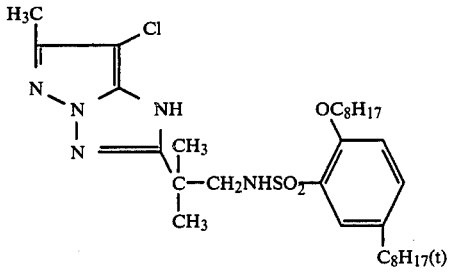
(I-16)
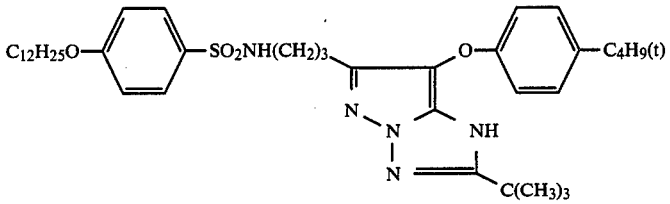
(I-17)
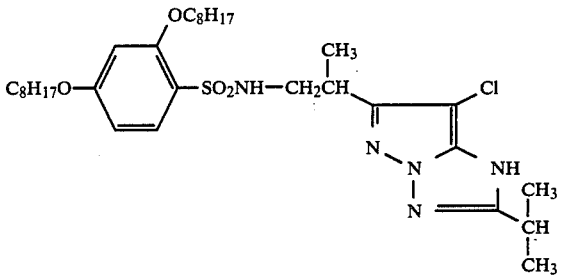
(I-18)
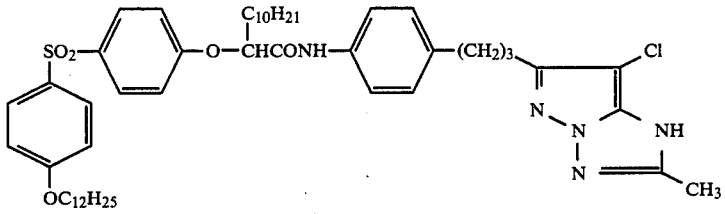
(I-19)
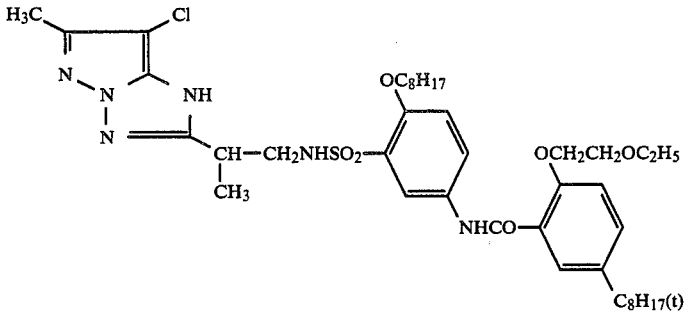

-continued
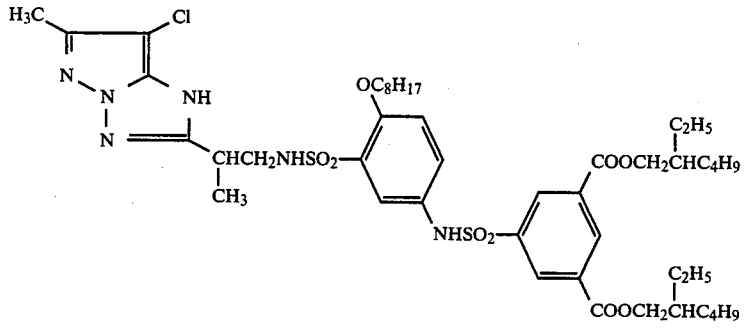
(I-20)
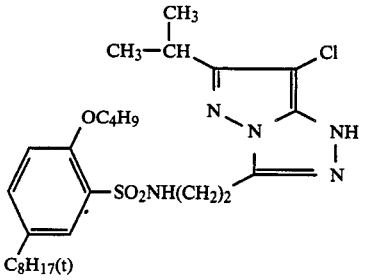
(I-21)
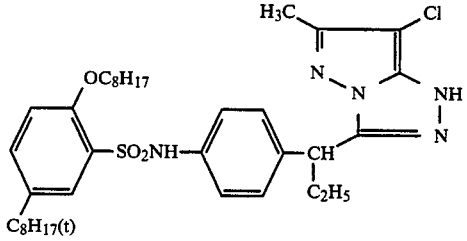
(I-22)
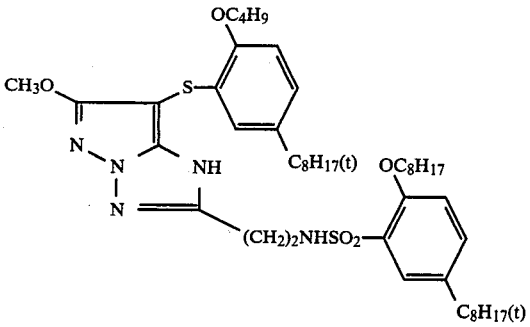
(I-23)
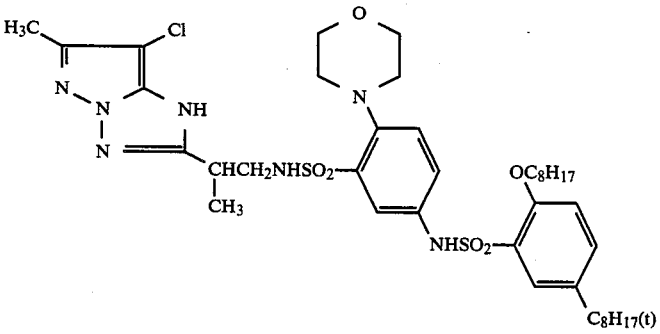
(I-24)
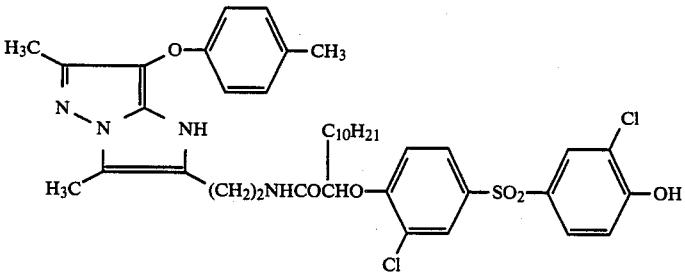
(I-25)

-continued
(I-26)
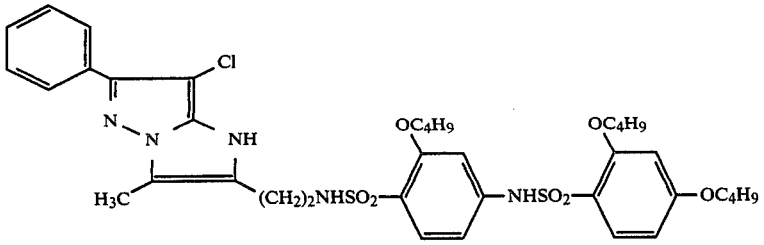
(I-27)
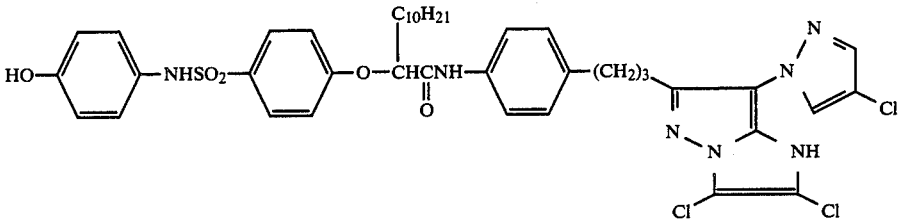
(I-28)
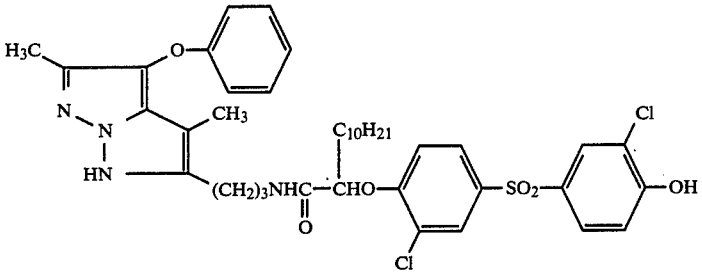
(I-29)
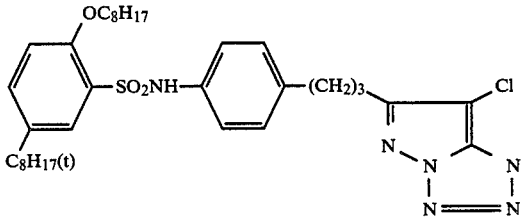
(I-30)
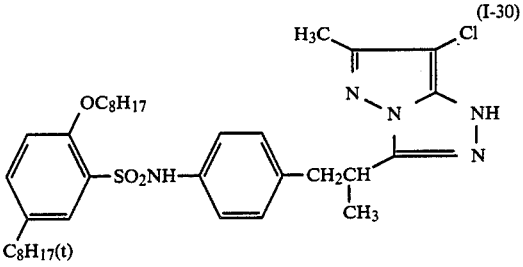
(I-31)
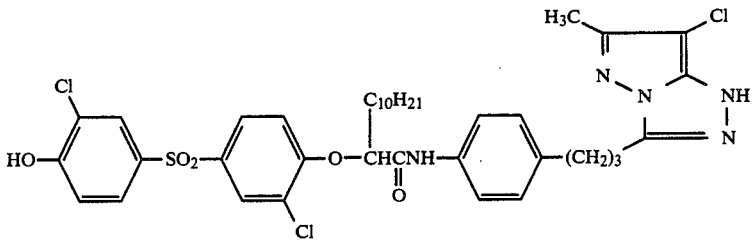
(I-32)
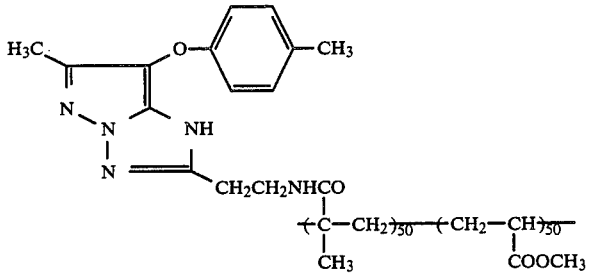

-continued

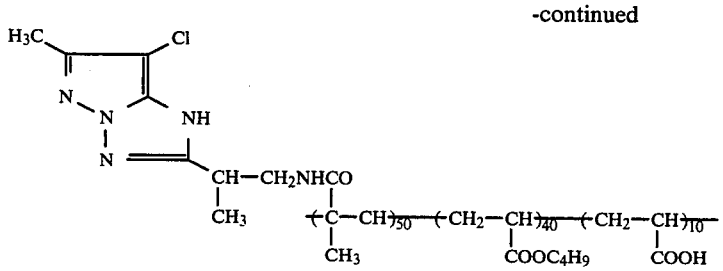

(I-33)

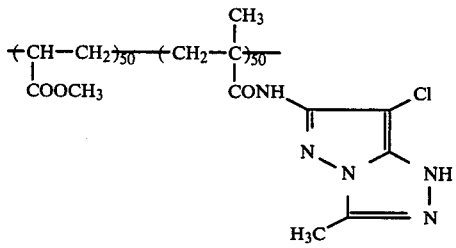

(I-34)

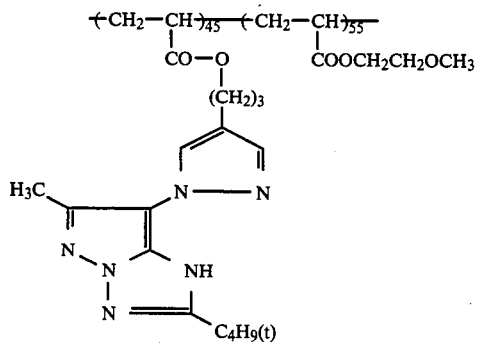

(I-35)

The coupler of formula (I) according to the present invention is used in an amount of from $2\times10^{-3}$ to $5\times10^{-1}$ mol, preferably from $1\times10^{-2}$ to $5\times10^{-1}$ mol, per mol of silver.

The compounds represented by formula (II) according to the present invention are described in more detail below.

In formula (II), the alkyl group are represented by R preferably contains 8 or more carbon atoms and includes substituted or unsubstituted straight chain or branched chain alkyl groups, substituted or unsubstituted aralkyl groups, and substituted or unsubstituted cycloalkyl groups. Specific examples thereof include an n-octyl group, an n-dodecyl group, an n-hexadecyl group, a t-dodecyl group, a sec-hexadecyl group, a phenethyl group, a 4-butylcyclohexyl group. The alkenyl group as represented by R preferably contains 8 or more carbon atoms, including cycloalkenyl groups. The aryl group as represented by R preferably contains 8 or more carbon atoms and specifically includes a 4-sec-dodecylphenyl group, a 4-t-butylphenyl group, a 4-t-octylphenyl group, a 4-octanamidophenyl group, an α-naphthyl group, a 2-dodecyloxy-5-t-amylphenyl group, etc.

The alkyl group and the aryl group used in the specification include those substituted with a substituent such as an alkyl group, an aryl group, an alkenyl group, an aryl group, a benzyl group, a halogen atom, a nitro group, a cyano group, a hydroxyl group, an alkyloxy group, a cycloalkyloxy group, an aryloxy group, a benzyloxy group, an alkylthio group, an arylthio group, an amino group, an alkylamino group, an acylamino group, a sulfonamido group, an alkoxycarbonyl group, a silyl group, an acyloxy group, a sulfamoyl group, a sulfonyl group, and the like.

Typical examples of the compounds represented by formula (II) are illustrated below, but the compounds usable in the present invention are not limited thereto.

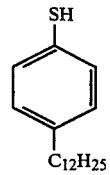

(II-1)

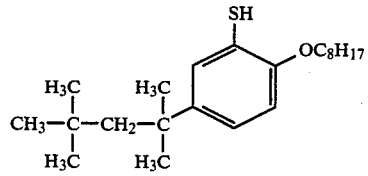

(II-2)

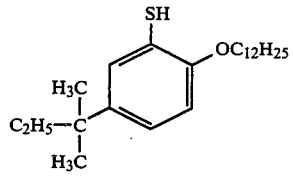

(II-3)

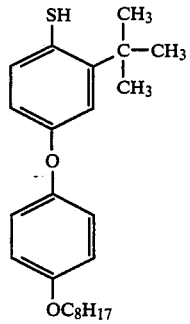

(II-4)

-continued
(II-5)
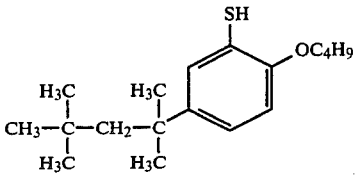
(II-6)
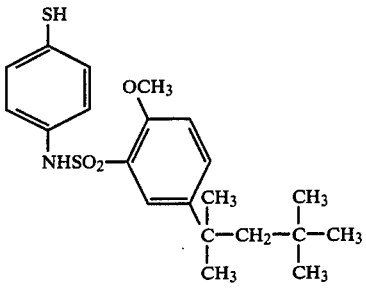
(II-7)
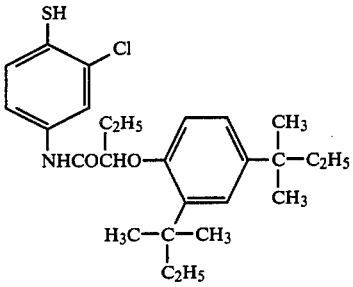
(II-8)
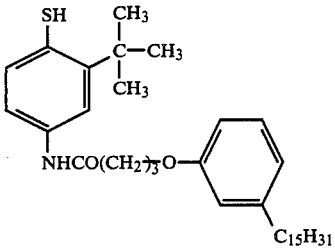
(II-9)
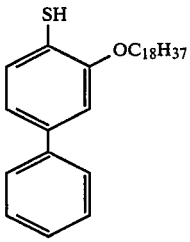
(II-10)
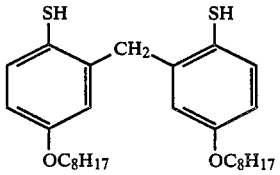
(II-11)
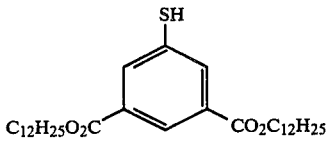
-continued
(II-12)
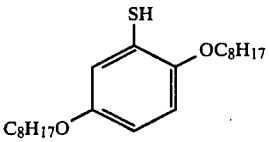
(II-13)
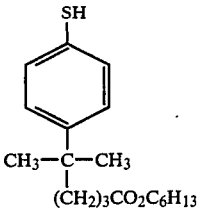
(II-14)
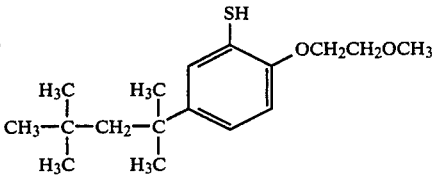
(II-15)
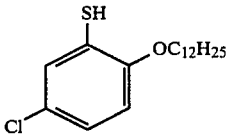
(II-16)
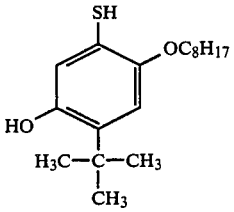
(II-17)
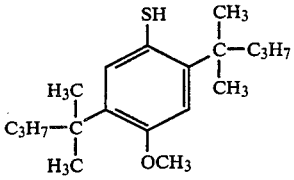
(II-18)
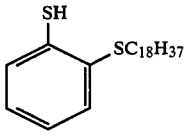
(II-19)
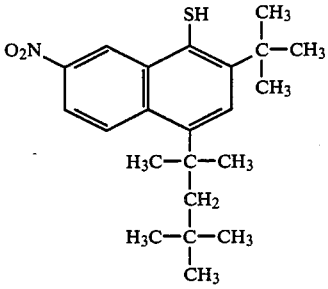
$C_{10}H_{21}SH$ (II-20)
$C_{12}H_{25}SH$ (II-21)
$C_{14}H_{29}SH$ (II-22)
$C_{16}H_{31}SH$ (II-23)
$C_{18}H_{37}SH$ (II-24)

-continued (II-25)

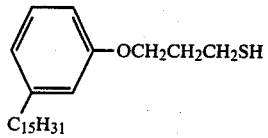

(II-26)

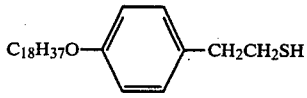

(II-27)

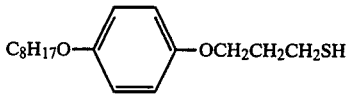

$C_{13}H_{27}CONHCH_2CH_2CH_2SH$ (II-28)

(II-29)

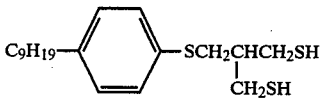

(II-30)

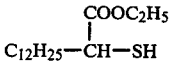

(II-31)

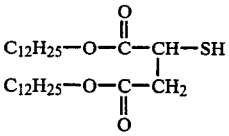

The compounds of formula (II) can by synthesized by the process described in U.S. Pat. No. 4,351,897.

The lipophilic fine particles according to the present invention are fine particles that are insoluble in a gelatin aqueous solution and exist as an independent phase in a gelatin aqueous solution. The state where the lipophilic fine particles contain the lipophilic couplers or the lipophilic mercapto compounds of formula (II) includes not only embodiments where these compounds are dissolved in the lipophilic fine particles but also embodiments where they are impregnated in the particles.

The lipophilic fine particles are comprised of at least one of (i) oily solvents (inclusive of those which are solid at room temperature, such as waxes) for additives, such as couplers, (ii) latex polymers, and (iii) additives that also serve as oily solvents such as some couplers, color mixing preventing agents, ultraviolet absorbents and the like additives.

The lipophilic fine particles of the present invention are usually prepared by dissolving the coupler of formula (I) and the mercapto compound of formula (II) in a high boiling solvent (oil) having a boiling point of 170° C. or higher at atmospheric pressure, or a low boiling solvent (in cases when no oil is necessary, i.e., when the additives (iii) described above are used), or a mixed solvent of such an oil and a low boiling solvent, and then emulsifying and dispersing the resulting solution in an aqueous solution of a hydrophilic colloid, such as gelatin. The particle size (diameter) of the lipophilic fine particles is not particularly restricted, but preferably ranges from 0.05 to 0.5 μm, and more preferably from 0.1 to 0.3 μm.

The amount of the oil preferably ranges from 0.00 to 2.0 parts by weight per part by weight of the coupler.

In the lipophilic fine particles, the mercapto compound of formula (II) is preferably incorporated in an amount of from $5\times10^{-3}$ to 2 mols, more preferably from $2\times10^{-2}$ to 1 mol, per mol of the coupler of formula (I).

Specific examples of the aforesaid oils include alkyl phthalates, e.g., dibutyl phthalate, dioctyl phthalate, diisodecylphthalate, dimethoxyethyl phthalate, etc.; phosphoric esters, e.g., diphenyl phosphate, triphenyl phosphate, tricresyl phosphate, dioctylbutyl phosphate, monophenyl-p-t-butylphenyl phosphate, etc.; citric esters, e.g., acetyl tributyl citrate, etc.; benzoic esters, e.g., octyl benzoate, etc.; alkylamides, e.g., diethyllaurylamide, dibutyllaurylamide, etc.; fatty acid esters, e.g., dibutoxyethyl succinate, diethyl azelate, etc.; trimesic esters, e.g., tributyl trimesate, etc.; compounds containing an epoxy ring, e.g., the compounds described in U.S. Pat. No. 4,540,657, etc.; phenols, e.g.,

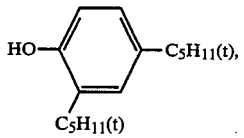

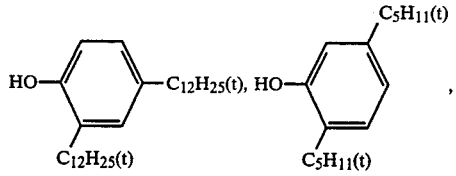

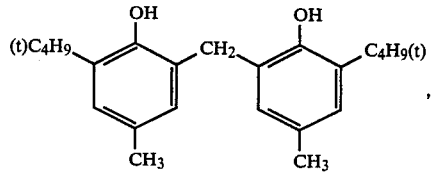

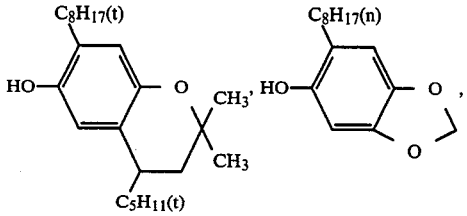

etc.; and ethers, e.g., phenoxyethanol, diethylene glycol monophenyl ether, etc.

The latex polymers to be used include those prepared from one or more monomers, such as acrylic acid and methacrylic acid and esters thereof, e.g., methyl acrylate, ethyl acrylate, butyl methacrylate, etc., acrylamide, methacrylamide, vinyl esters, e.g., vinyl acetate, vinyl propionate, etc., acrylonitrile, styrene, divinylbenzene, vinyl alkyl ethers, e.g., vinyl ethyl ether, etc., maleic esters, e.g., methyl maleate, etc., N-vinyl-2-pyrrolidone, N-vinylpyridine, 2- or 4-vinylpyridine, etc.

The low boiling solvents to be used for dissolving the additives, such as couplers, are organic solvents having a boiling point of from about 30 to 150° C. at atmospheric pressure, such as lower alkyl acetates (e.g., ethyl acetate, isopropyl acetate, butyl acetate, etc.), ethyl propionate, methanol, ethanol, secbutyl alcohol, cyclohexanol, fluorinated alcohols, methyl isobutyl ketone, β-ethoxyethyl acetate, methyl cellosolve acetate, acetone, methylacetone, acetonitrile, dioxane, dimethylformamide, dimethyl sulfoxide, chloroform, cyclohexane, etc.

Two or more couplers of formula (I) according to the invention may be incorporated in the same emulsion layer.

The light-sensitive materials of the present invention may contain cyan and yellow couplers in addition to the above-described magehta couplers. Typical examples of the cyan and yellow couplers include naphthol or phenol compounds and open-chain or heterocyclic ketomethylene compounds. Specific examples of such cyan and yellow couplers which can be used in the present invention are described in patents cited in *Research Disclosure,* No. 17643, Item VII-D (December, 1978) and ibid., No. 18717 (November, 1979).

The color couplers to be incorporated in light-sensitive materials preferably contain a ballast group or have a polymerized form so as to be non-diffusible. Further, 2-equivalent color couplers in which the coupling position is substituted with a releasable group are advantageous over 4-equivalent ones in which the coupling position is a hydrogen atom in view of reduction of the requisite amount of silver. Couplers forming dyes with moderate diffusibility, colorless couplers, DIR couplers capable of releasing development inhibitors upon coupling, or DAR couplers capable of releasing development accelerators upon coupling may also be employed in the light-sensitive materials of the invention.

The yellow couplers which can be used in the present invention typically include oil-protected acylacetamide couplers. Specific examples thereof are described in U.S. Pat. Nos. 2,407,210, 2,875,057, and 3,265,506. It is desirable to use 2-equivalent yellow couplers, typically including oxygen atom-releasing yellow couplers as described in U.S. Pat. Nos. 3,408,194, 3,447,928, 3,933,501 and 4,022,620; and nitrogen atomreleasing yellow couplers as described in Japanese Patent Publication No. 10739/83, U.S. Pat. Nos. 4,401,752 and 4,326,024, *Research Disclosure,* No. 18053 (April, 1979), British Pat. No. 1,425,020, West German Patent Application (OLS) Nos. 2,219,917, 2,261,361, 2,329,587 and 2,433,812, etc. α-Pivaloylacetanilide couplers produce dyes excellent in fastness, in particular, to light. α-Benzoylacetanilide couplers provide high color densities.

The cyan couplers which can be used in the invention include oil-protected naphthol and phenol couplers. Typical examples thereof are naphthol couplers described in U.S. Pat. No. 2,474,293, and preferably 2-equivalent oxygen atom-releasing naphthol couplers described in U.S. Pat. Nos. 4,052,212, 4,146,396, 4,228,233 and 4,296,200, and phenol couplers described in U.S. Pat. Nos. 2,369,929, 2,801,171, 2,772,162 and 2,895,826. Cyan couplers fast to high humidity and high temperature are preferred. Typical examples of such cyan couplers are phenol couplers having an alkyl group containing 2 or more carbon atoms at the m-position of the phenol nucleus as disclosed in U.S. Pat. No. 3,772,002; 2,5-diacylamino-substituted phenol couplers as disclosed in U.S. Pat. Nos. 2,772,162, 3,758,308, 4,126,396, 4,334,011 and 4,327,173, West German Patent Application (OLS) No. 3,329,729 and Japanese Patent Application (OPI) No. 166956/84; and phenol couplers having a phenylureido group at the 2-phenol and an acylamino group at the 5-position as disclosed in U.S. Pat. Nos. 3,446,622, 4,333,999, 4,451,559 and 4,427,767.

In order to satisfy characteristic requirements for the light-sensitive materials, two or more of the aforesaid various couplers may be introduced into the same light-sensitive layer, or a particular compound may be introduced into two or more layers.

These couplers as described above can be incorporated in light-sensitive materials by various known dispersion methods, for example, a solid dispersion method, preferably a latex dispersion method, and more preferably an oil-in-water dispersion method. In the oil-in-water dispersion method, the coupler is dissolved in a high boiling point organic solvent having a boiling point of 175° C. or higher, a low boiling point solvent (so-called auxiliary solvent), or a mixture thereof, and the solution is finely dispersed in an aqueous medium, such as water and a gelatin aqueous solution, in the presence of a surface active agent. Specific examples of the high boiling point solvents are described in U.S. Pat. No. 2,322,027, etc.

A standard amount of the color coupler to be used is in the range of from 0.001 to 1 mol per mol of a light-sensitive silver halide, and a preferred amount of the yellow coupler is from 0.01 to 0.5 mol, and that of the cyan coupler is from 0.002 to 0.3 mol, both per mol of a light-sensitive silver halide.

Silver halide emulsions which can be used in the present invention are usually prepared by mixing a solution of a water-soluble silver salt (e.g., silver nitrate) and a water-soluble halogen salt (e.g., potassium bromide, sodium chloride or potassium iodide, or a mixture thereof) in the presence of a solution of a water-soluble high polymer, e.g., gelatin.

Silver halide grains to be used may have any of structure composed of a core and an outer shell being different in halogen composition, a multiphase structure having a fused structure, a uniform phase throughout the individual grains, or a mixture thereof. For example, silver chlorobromide grains having different phases may have a nucleus or a single layer or plural layers rich in either silver bromide or silver chloride over the averaged halogen composition.

The mean grain size of silver halide grains, being defined as grain diameter for spherical or nearly spherical grains or as edge length for cubic grains, each being averaged based on the projected area of the grains, preferably ranges from 0.1 to 2 μm, and more preferably from 0.15 to 1 μm. A grain size distribution may be either narrow or broad.

In the present invention, a so-called monodispersed silver halide emulsion may be employed. As an indication of a degree of monodispersion, the coefficient of variation obtained by dividing a standard deviation derived from a grain size distribution curve by a mean grain size is preferably not more than 15%, and more preferably not more than 10%. In order to obtain a desired gradation, two or more monodispersed silver halide emulsions being different in grain size may be incorporated in one layer or separate layers having substantially the same color sensitivity. Further, two or more of polydispersed silver halide emulsions or a combination of a monodispersed emulsion and a polydispersed emulsion may be incorporated in one or more layers.

The silver halide grains to be used in the present invention may have either a regular crystal form, e.g., a cube, an octahedron, a dodecahedron, a tetradecahedron, etc.; or an irregular crystal form, e.g., a sphere, etc.; or a composite form of these crystal forms. Plate-like (tabular) grains may also be employed. For example, an emulsion containing 50% or more of plate-like grains, particularly those having a diameter to thickness ratio of 5 (i.e., 5/1) or more, and especially 8 or more, based on the total projected area, can be used. The emulsion may comprise a mixture of these various crystal forms. The emulsion may be either of the surface latent image type which forms a latent image predominantly on the surface thereof or of the inner latent image type which forms a latent image predominantly in the interior thereof.

The photographic emulsion which can be used in the present invention can be prepared by known processes, as described, e.g., in P. Glafkides, *Chimie et Physique Photographique,* Paul Montel (1967); G. F. Duffin, *Photographic Emulsion Chemistry,* Focal Press (1966); V. L. Zelikman, et al., *Making and Coating Photographic Emulsion,* Focal Press (1964), etc. That is, the emulsion can be prepared according to any of the acid process, the neutral process, the ammonia process, and the like. A soluble silver salt and a soluble halogen salt are reacted in accordance with any of a single jet process, a double jet process, a combination thereof, etc. A so-called reverse mixing method in which silver halide grains are formed in the presence of excess silver ions, or a conversion method in which a halogen salt capable of forming a less soluble silver halide is added may be employed. In addition, a so-called controlled double jet method, in which the pAg value of the liquid phase wherein silver halide grains are to be precipitated is maintained constant, may also be used. According to this method, silver halide emulsions in which grains have a regular crystal form and an almost uniform size can be obtained.

In the course of the grain formation or physical ripening, a cadmium salt, a zinc salt, a lead salt, a thallium salt, an iridium salt or a complex salt thereof, a rhodium salt or a complex salt thereof, an iron salt or a complex salt thereof, etc., may be present.

After grain formation, the silver halide emulsion is usually subjected to physical ripening, desalting, and chemical ripening prior to coating.

During the grain formation, physical ripening, and chemical ripening, known silver halide solvents can be used. Examples of the silver halide solvents include ammonia, potassium thiocyanate, and the thioethers and thiones described in U.S. Pat. No. 3,271,157, and Japanese Patent Application (OPI) Nos. 12360/76, 82408/78, 144319/78, 100717/79 and 155828/79. Removal of soluble silver salts from the emulsion after physical ripening can be carried out by a noodle washing method, a flocculation or sedimentation method, an ultrafiltration method, and the like.

The photographic emulsions to be used in the invention can be spectrally sensitized with methine dyes or others, if desired.

For the purpose of preventing fog during the preparation, preservation, or photographic processing of the light-sensitive materials or stabilizing photographic performances of the light-sensitive materials, various compounds can be added to the photographic emulsions.

The light-sensitive materials of this invention can contain hydroquinone derivatives, aminophenol derivatives, amines, gallic acid derivatives, catechol derivatives, ascorbic acid derivatives, colorless couplers, sulfonamidophenol derivatives, etc., as color fog inhibitors or color mixing inhibitors.

The light-sensitive materials of the present invention can contain various discoloration inhibitors.

The light-sensitive materials of the present invention can contain ultraviolet absorbents in their hydrophilic colloidal layers.

The light-sensitive materials of the present invention can contain one or more surface active agents for a wide variety of purposes, such as for coating aid, static charge prevention, improvement of slipperiness, emulsification and dispersion aid, prevention of adhesion, improvement on photographic characteristics (e.g., development acceleration, increase of contrast, increase of sensitivity, and the like), and the like.

In addition to the foregoing additives, the light-sensitive materials according to the present invention may further contain stabilizers, stain inhibitors, developing agents or precursors thereof, development accelerators or precursors thereof, lubricants, mordants, matting agents, antistatics, plasticizers, and other photographic additives. Typical examples of these additives are described in *Research Disclosure,* No. 17643 (December, 1978) and ibid., No. 18716 (November, 1979).

The present invention is applicable to multilayer multicolor photographic materials comprising a support having provided thereon at least two layers being different in spectral sensitivity. Multilayer multicolor photographic materials generally comprise a support having formed thereon at least one red-sensitive emulsion layer, at least one green-sensitive emulsion layer, and at least one blue-sensitive emulsion layer in an order arbitrarily selected. Each of these emulsion layers may be composed of two or more layers different in sensitivity. Between two or more emulsion layers having the same light sensitivity, a light-insensitive layer may be provided.

In addition to the silver halide emulsion layers, the light-sensitive materials preferably contain auxiliary layers, such as a protective layer, an intermediate layer, a filter layer, an antihalation layer, a backing layer, etc.

The photographic emulsion layers and other layers are coated on a commonly employed flexible support, e.g., plastic films, paper, cloth, etc., or a rigid support, e.g., glass, ceramics, metals, etc. A preferred support is baryta paper or a paper support laminated with polyethylene having dispersed therein a white pigment, e.g., titanium dioxide.

The present invention can be applied to various types of light-sensitive materials, such as color negative films for general use or for movies, color reversal films for slides or TV, color papers, color positive films, and color reversal papers. The present invention is also applicable to black-and-white light-sensitive materials utilizing three color coupler mixing as described, e.g., in *Research Disclosure,* No. 17123 (July, 1978).

A color developing solution to be used for development processing to the light-sensitive materials of the invention is preferably an alkaline aqueous solution containing, as a main component, an aromatic primary amine color developing agent, e.g., p-phenylenediamine compounds. Specific examples of the p-phenylenediamine developing agents are 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, and sulfates, hydrochlorides, or p-toluenesulfonates thereof.

The color developing solution generally contains preservatives, such as alkali metal sulfites, hydroxylamine, etc., pH buffers, such as carbonates, borates, or phosphates or alkali metals, development restrainers or antifoggants, such as bromides, iodides, benzimidazoles, benzothiazoles, mercapto compounds, etc., and the like. The developing solution may also contain organic solvents, e.g., benzyl alcohol, diethylene glycol, etc., development accelerators, e.g., polyethylene glycol quaternary ammonium salts, amines, etc., and the like.

After the color development, the photographic layers are usually subjected to bleaching. The bleaching may be conducted simultaneously with fixation, or these two procedures may be effected separately.

Bleaching agents which can be used include compounds of polyvalent metals, e.g., iron (III), cobalt (III), chromium (VI), copper (II), etc., peracids, quinones, nitroso compounds, and so on. Typical examples of these compounds are ferricyanides; bichromates; organic complex salts of iron (III) or cobalt (III) with aminopolycarboxylic acids, e.g., ethylenediaminetetraacetic acid, diethylenetriaminepentaacetic acid, nitrilotriacetic acid, 1,3-diamino-2-propanoltetraacetic acid, etc., or organic acids, e.g., citric acid, tartaric acid, malic acid, etc.; persulfates; manganates; nitrosophenol; and the like. Of these bleaching agents, ethylenediaminetetraacetato iron (III) complexes and persulfates are preferred from the standpoint of rapid processing and environmental conservation. In particular, the ethylenediaminetetraacetato iron (III) complexes are useful in both an independent bleaching bath and a combined bleach-fix monobath.

If desired, the bleaching or bleach-fix bath may contain various accelerators.

The bleach-fix or fixation is usually followed by washing with water. In order to prevent precipitation or to save water, various known additives can be used in the washing. For example, water softeners for prevention of precipitation, such as inorganic or organic phosphoric acids, aminopolycarboxylic acids, etc.; bacteriocides or fungicides; hardening agents, such as magnesium salts and aluminum salts; and surface active agents for prevention of drying load or uneven drying can be added according to the need therefor. In addition, the compounds described in L. E. West, *Water Quality Criteria,* and *Photo. Sci. Eng.,* Vol. 6, pp. 344–359 (1965) are also usable. In particular, addition of chelating agents and fungicides is effective.

The washing step is generally carried out in a countercurrent system using two or more vessels to effect a water saving. The washing step may be replaced by a multistage countercurrent stabilization step as proposed in Japanese Patent Application (OPI) No. 8543/82. The stabilizing bath to be used contains various additives for the purpose of image stabilization, such as buffering agents for adjusting the pH of the film to, e.g., 3 to 8, such as borates, metaborates, borax, phosphates, carbonates, potassium hydroxide, sodium hydroxide, aqueous ammonia, monocarboxylic acids, dicarboxylic acids, polycarboxylic acids, etc.; and formalin. Other additives that may be used if desired include water softeners, e.g., inorganic or organic phosphoric acids, aminopolycarboxylic acids, phosphonocarboxylic acids, etc.; bacteriocides, e.g., benzisothiazolinone, isothiazolone, 4-thiazolinebenzimidazole, halogenated phenols, etc.; surface active agents, fluorescent brightening agents, hardening agents, and the like. These additives may be used in combinations of two or more thereof selected for the same or different purposes.

It is preferable to use an ammonium salt, e.g., ammonium chloride, ammonium nitrate, ammonium sulfate, ammonium phosphate, ammonium sulfite, ammonium thiosulfate, etc., as a film pH adjustor after the processing.

The silver halide color photographic material according to the present invention may contain, if desired, 1-phenyl-3-pyrazolidone compounds for color development acceleration. Typical examples of these compounds are described, e.g., in Japanese Patent Application (OPI) Nos. 64339/81, 144547/82, 211147/82, 50532 to 50536/83, and 115438/83.

Each of the above-described processing solutions is used in a temperature range of from 10° to 50° C., and preferably from 33° to 38° C. For a silver saving, processing using a cobalt intensifier or a hydrogen peroxide intensifier as described in West German Pat. No. 2,226,770 or U.S. Pat. No 3,674,499 can be performed.

If necessary, the processing baths may be equipped with a heater, a temperature sensor, a liquid level sensor, a circulating pump, a filter, a floating lid, a squeegee, etc.

This invention will now be illustrated in greater detail with reference to the following examples, but it should be understood that they are not intended to limit the present invention.

EXAMPLE 1

A light-sensitive material was prepared by coating first (the undermost) to seventh (the uppermost) layers on a paper support laminated on both sides thereof with polyethylene according to the following layer structure:

| | |
|---|---|
| First Layer: Blue-Sensitive Layer | |
| Mixed silver chlorobromide emulsion (*a) | 400 mg of Ag/m$^2$ |
| Yellow coupler (*b) | 690 mg/m$^2$ |
| Solvent (DBP) | 500 mg/m$^2$ |
| Gelatin | 1,200 mg/m$^2$ |
| Second Layer: Color Mixing Preventing Layer | |
| Color mixing inhibitor (*c) | 400 mg/m$^2$ |
| Solvent (DBP) | 100 mg/m$^2$ |
| Gelatin | 1,000 mg/m$^2$ |
| Third Layer: Green-Sensitive Layer | |
| Mixed silver chlorobromide emulsion (*a) | 340 mg of Ag/m$^2$ |
| Magenta coupler (*d) | 320 mg/m$^2$ |
| Discoloration inhibitor (*e) | 320 mg/m$^2$ |
| Solvent (tricresyl phosphate) | 250 mg/m$^2$ |
| Solvent (trioctyl phosphate) | 500 mg/m$^2$ |
| Sodium 2-sulfo-5-n-pentadecyl-hydroquinone | 18 mg/m$^2$ |
| Gelatin | 1,200 mg/m$^2$ |
| Fourth Layer: Color Mixing Preventing Layer | |
| Color mixing inhibitor (*c) | 200 mg/m$^2$ |
| Ultraviolet absorbent (*f) | 150 mg/m$^2$ |
| Solvent (DBP) | 60 mg/m$^2$ |
| Gelatin | 1,000 mg/m$^2$ |
| Fifth Layer: Red-Sensitive Layer | |
| Mixed silver chlorobromide emulsion (*a) | 250 mg of Ag/m$^2$ |
| Cyan coupler (*g) | 400 mg/m$^2$ |
| Ultraviolet absorbent (*f) | 100 mg/m$^2$ |
| Solvent (DBP) | 240 mg/m$^2$ |
| Gelatin | 600 mg/m$^2$ |
| Sixth Layer: Ultraviolet Absorbing Layer | |
| Ultraviolet absorbent (*f) | 350 mg/m$^2$ |
| Solvent (DBP) | 60 mg/m$^2$ |
| Gelatin | 1,000 mg/m$^2$ |
| Seventh Layer: Protective Layer | |
| Gelatin | 1,600 mg/m$^2$ |

(*a): Mixed silver chlorobromide as shown in the Table below was used.

The thus prepared sample was designated as Sample (A). The compounds used in the preparation of Sample (A) were as follows:

| Mixed Silver Chloro-bromide | Mean Grain Size (γ) Measured by Projected Area Method (μm) | Coefficient of Variation (S*/γ) | Silver Bromide Content (mol %) | Mixed Ratio by Weight |
|---|---|---|---|---|
| First Layer | | | | |
| Em 1 | 1 | 0.08 | 80 | 1/1 |
| Em 2 | 0.75 | 0.07 | 80 | (Em 1/Em 2) |
| Third Layer | | | | |
| Em 3 | 0.5 | 0.09 | 70 | 3/7 |
| Em 4 | 0.4 | 0.10 | 70 | (Em 3/Em 4) |
| Fifth Layer | | | | |
| Em 5 | 0.5 | 0.09 | 70 | 3/7 |

-continued

| Mixed Silver Chloro-bromide | Mean Grain Size (γ) Measured by Projected Area Method (μm) | Coefficient of Variation (S*/γ) | Silver Bromide Content (mol %) | Mixed Ratio by Weight |
|---|---|---|---|---|
| Em 6 | 0.4 | 0.10 | 70 | (Em 5/Em 6) |

*S stands for statistic standard deviation.

*b:

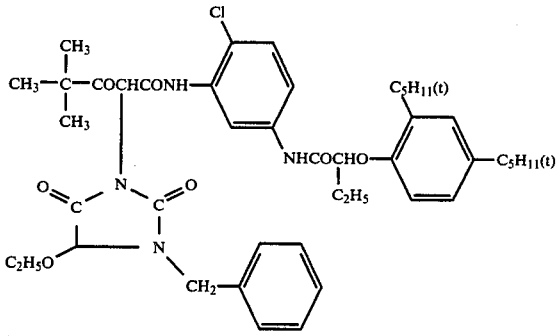

*c: 2,5-Dioctylhydroquinone

*d: Compound M1-7 of Japanese Patent Application (OPI) No. 21048/85 having formula:

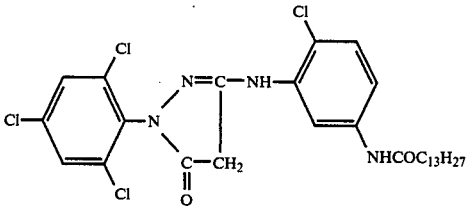

*e: 3,3,3',3'-Tetramethyl-5,6,5',6'-tetrapropyloxy-bis-1,1'-spiroindan

*f: A 1/5/3 (by mol) mixture of

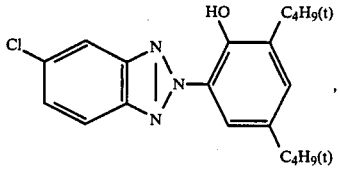

,

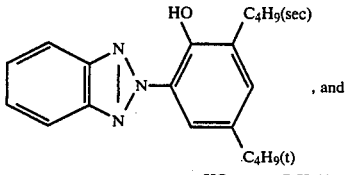

, and

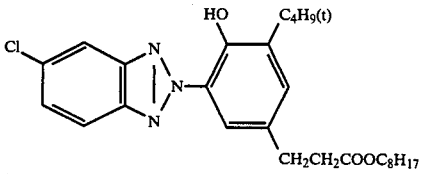

*g:

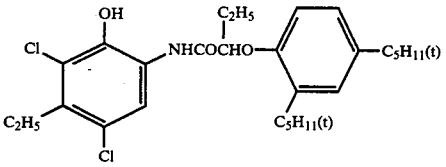

DBP: Dibutyl phosphate

Samples (B) to (D) and (J) for comparison and Samples (E) to (I) and (K) according to the present invention were prepared in the same manner as for Sample (A) except for the following variations.

Sample (B):

The third layer further contained 0.3 mol of Compound (II-3) per mol of the magenta coupler.

Sample (C):

The third layer further contained 0.3 mol of Compound (II-24) per mol of the magenta coupler.

Sample (D):

In the third layer, the mixed silver chlorobromide emulsion (silver bromide: 70 mol%) was coated to a silver coverage of 180 mg/m$^2$ and the magenta coupler (*d) was replaced with 380 mg/m$^2$ of Compound (I-5).

Sample (E):

The same layer structure as Sample (D) except that the third layer further contained 0.3 mol of Compound (II-1) per mole of the magenta coupler.

Sample (F):

The same layer structure as Sample (D) except that the third layer further contained 0.3 mol of Compound (II-3) per mol of the magenta coupler.

Sample (G):

The same layer structure as Sample (D) except that the third layer further contained 0.3 mol of Compound (II-21) per mol of the magenta coupler.

Sample (H):

The same layer structure as Sample (D) except that the third layer further contained 0.3 mol of Compound (II-24) per mol of the magenta coupler.

Sample (I):

The same layer structure as Sample (D) except that the third layer further contained 0.3 mol of Compound (II-26) per mol of the magenta coupler.

Sample (J):

The same layer structure as Sample (D) except that the magenta coupler as used in Sample (D) was replaced with the same molar amount of Compound (I-20).

Sample (K):

The same layer structure as Sample (J) except that the third layer further contained 0.3 mol of Compound (II-3) per mol of the magenta coupler.

Each of Samples (A) to (K) was exposed to light through an optical wedge and subjected to color development processing according to the following procedures. In order to distinguish the effects of the present invention, the processing procedures are designed so that the developing agent or other processing solution components may readily remain in the light-sensitive material to cause stains.

| Processing Step | Temperature (°C.) | Time |
|---|---|---|
| Color Development | 33 | 3 min 30 sec |
| Bleach-Fix | 33 | 1 min 30 sec |
| Washing | 20–25 (with no stirring) | 1 min |
| Drying | 50–80 | 2 min |

The formulations of the processing solutions used were as follows:

Color Developing Solution Formulation

| | |
|---|---|
| Trisosium Nitrilotriacetate | 2.0 g |
| Benzyl Alcohol | 15 ml |
| Diethylene Glycol | 10 ml |
| Sodium Sulfite | 0.2 g |
| Potassium Bromide | 0.5 g |
| Hydroxylamine Sulfate | 3.0 g |
| 4-Amino-3-methyl-N—ethyl-N—[β-(methanesulfonamido)ethyl]-p- | 7.0 g |

-continued

| | |
|---|---|
| phenylenediamine Sulfate | |
| Sodium Carbonate Monohydrate | 30 g |
| Water to make | 1,000 ml |
| | pH 10.1 |

Bleach-Fix Bath Formulation

| | |
|---|---|
| The color developing solution as described above | 400 ml |
| Ammonium Thiosulfate (70 wt %) | 150 ml |
| Sodium Sulfite | 12 g |
| Sodium (Ethylenediaminetetraacetato)-iron | 36 g |
| Disodium Ethylenediaminetetraacetate | 4 g |
| Water to make | 1,000 ml |
| 1 N Sulfuric acid to adjust pH to | 7.0 |

The above-described bleach-fix bath was used after aeration for 1 hour. The bleach-fix bath was formulated so as to have an estimated composition deteriorated due to incorporation of a large amount of the color developing solution carried with the light-sensitive material during running.

Each of the thus processed Samples (A) to (K) was measured for magenta and yellow reflection densities of the unexposed area 1 hour after the processing by the use of an automatic recording densitometer manufactured by Fuji Photo Film Co., Ltd. Then, the samples were allowed to stand in the dark for 6 days under conditions of 80° C. and 70% RH (relative humidity), and the magenta and yellow reflection densities of the unexposed area were again measured. A difference between the magenta and yellow densities of the unexposed area after preservation for forced deterioration and those after 1 hour from the processing, respectively, was taken as a stain increase. The results obtained are shown in Table 1.

TABLE 1

| Sample No. | Coupler | Mercapto Compound | Stain Increase on Unexposed Area Magenta | Yellow | Remarks |
|---|---|---|---|---|---|
| (A) | (*d) | — | 0.20 | 0.35 | Comparison |
| (B) | (*d) | (II-3) | 0.19 | 0.31 | " |
| (C) | (*d) | (II-24) | 0.19 | 0.30 | " |
| (D) | (I-5) | — | 0.33 | 0.18 | " |
| (E) | (I-5) | (II-1) | 0.18 | 0.18 | Invention |
| (F) | (I-5) | (II-3) | 0.15 | 0.17 | " |
| (G) | (I-5) | (II-21) | 0.14 | 0.19 | " |
| (H) | (I-5) | (II-24) | 0.16 | 0.18 | " |
| (I) | (I-5) | (II-26) | 0.13 | 0.17 | " |
| (J) | (I-20) | — | 0.38 | 0.20 | Comparison |
| (K) | (I-20) | (II-3) | 0.14 | 0.18 | Invention |

EXAMPLE 2

Each of Samples (A) to (K) as prepared in the same manner as in Example 1 was exposed to light through an optical wedge and subjected to color development processing in accordance with the following procedures:

| Processing Step | Temperature (°C.) | Time |
|---|---|---|
| Color Development | 33 | 3 min 30 sec |
| Bleach-Fix | 33 | 1 min 30 sec |
| Washing | 33 | 3 min |
| Drying | 50–80 | 2 min |

Each of the processing solutions used had the following formulation:

Color Developing Solution Formulation

| | |
|---|---|
| Benzyl Alcohol | 12 ml |
| Diethylene Glycol | 5 ml |
| Potassium Carbonate | 25 g |
| Sodium Chloride | 0.1 g |
| Sodium Bromide | 0.5 g |
| Anhydrous Sodium Sulfite | 2 g |
| Hydroxylamine Sulfate | 2 g |
| Fluorescent Brightening Agent | 1 g |
| N—ethyl-N—β-methanesulfonamidoethyl-3-methyl-4-aminoaniline Sulfate | 4 g |
| Water to make | 1,000 ml |
| NaOH to adjust pH to | 10.2 |

Bleach-Fix Bath Formulation

| | |
|---|---|
| Ammonium Thiosulfate | 124.5 g |
| Sodium Metabisulfite | 13.3 g |
| Anhydrous Sodium Sulfite | 2.7 g |
| Ammonium (Ethylenediaminetetraacetato)-ferrite | 65 g |
| The color developing solution as described above | 100 ml |
| pH adjustor to adjust pH to | 6.7–6.8 |
| Water to make | 1,000 ml |

These processing solutions were running solutions which had been used in an ordinary roller transport type developing machine with normal replenishment so that each composition virtually came to equilibrium.

Densities of the processed samples were measured in the same manner as in Example 1 to evaluate stain increases. The results obtained are shown in Table 2 below.

TABLE 2

| Sample No. | Coupler | Mercapto Compound | Stain Increase on Unexposed Area Magenta | Yellow | Remarks |
|---|---|---|---|---|---|
| (A) | (*d) | — | 0.12 | 0.30 | Comparison |
| (B) | (*d) | (II-3) | 0.11 | 0.26 | " |
| (C) | (*d) | (II-24) | 0.11 | 0.26 | " |
| (D) | (I-5) | — | 0.16 | 0.15 | " |
| (E) | (I-5) | (II-1) | 0.10 | 0.15 | Invention |
| (F) | (I-5) | (II-3) | 0.09 | 0.16 | " |
| (G) | (I-5) | (II-21) | 0.08 | 0.17 | " |
| (H) | (I-5) | (II-24) | 0.09 | 0.15 | " |
| (I) | (I-5) | (II-26) | 0.07 | 0.15 | " |
| (J) | (I-20) | — | 0.17 | 0.18 | Comparison |
| (K) | (I-20) | (II-3) | 0.08 | 0.17 | Invention |

EXAMPLE 3

Each of Samples (A) to (K) as prepared in the same manner as in Example 1 was exposed to light through an optical wedge and subjected to color development processing in accordance with the following procedures. These procedures were so designed as to embody a running equilibrium state established by rapid processing, and the samples were processed according to the rapid processing with processing solutions therefor.

| Processing Step | Temperature (°C.) | Time* |
|---|---|---|
| Color Development | 37 | 1 min 40 sec |
| Bleach-Fix | 33 | 1 min 00 sec |
| Washing 1** | 30 | 20 sec |
| Washing 2** | 30 | 20 sec |

-continued

| Processing Step | Temperature (°C.) | Time* |
|---|---|---|
| Washing 3** | 30 | 20 sec |
| Drying | 80 | 1 min 00 sec |

Note:
*Each time included 10 seconds for transfer between baths.
**Washing was carried out in a countercurrent system of 3 → 2 → 1.

Color Developing Solution Formulation

| | |
|---|---|
| Water | 800 ml |
| Diethylenetriaminepentaacetic Acid | 3.0 g |
| Benzyl Alcohol | 15 ml |
| Diethylene Glycol | 10 ml |
| Sodium Sulfite | 2.0 g |
| Potassium Bromide | 0.5 g |
| Potassium Carbonate | 30.0 g |
| N—Ethyl-N—(β-methanesulfonamidoethyl)-3-methyl-4-aminoaniline Sulfate | 5.5 g |
| Hydroxylamine Sulfate | 4.0 g |
| Fluorescent Brightening Agent (stilbene type) | 1.0 g |
| Water to make | 1,000 ml |

Bleach-Fix Bath Formulation

| | |
|---|---|
| Ammonium Thiosulfate (70 wt %) | 200 ml |
| Sodium Sulfite | 18 g |
| Ammonium (Ethylenediaminetetraacetato)-iron (III) | 65 g |
| Disodium Ethylenediaminetetraacetate | 5 g |
| The color developing solution as described above | 350 ml |
| Water to make | 1,000 ml<br>pH: 7.00 |

Densities of the processed samples were measured in the same manner as in Example 1 to evaluate stain increases. The results obtained are shown in Table 3 below.

TABLE 3

| Sample No. | Coupler | Mercapto Compound | Stain Increase on Unexposed Area Magenta | Yellow | Remarks |
|---|---|---|---|---|---|
| (A) | (*d) | — | 0.13 | 0.29 | Comparison |
| (B) | (*d) | (II-3) | 0.12 | 0.25 | " |
| (C) | (*d) | (II-24) | 0.13 | 0.24 | " |
| (D) | (I-5) | — | 0.15 | 0.15 | " |
| (E) | (I-5) | (II-1) | 0.09 | 0.14 | Invention |
| (F) | (I-5) | (II-3) | 0.08 | 0.16 | " |
| (G) | (I-5) | (II-21) | 0.08 | 0.17 | " |
| (H) | (I-5) | (II-24) | 0.09 | 0.16 | " |
| (I) | (I-5) | (II-26) | 0.07 | 0.16 | " |
| (J) | (I-20) | — | 0.16 | 0.17 | Comparison |
| (K) | (I-20) | (II-3) | 0.08 | 0.15 | Invention |

EXAMPLE 4

A paper support laminated on both sides thereof with polyethylene was coated with the following first to eleventh layers in the order listed to prepare a comparative light-sensitive material. The polyethylene laminate on the first layer side contained titanium white as a white pigment and a trace amount of ultramarine as a blue dye. The resulting light-sensitive material was designated as Sample (L).

| First Layer: Antihalation Layer | |
|---|---|
| Black colloidal silver | 0.01 g of Ag/m$^2$ |

-continued

| | |
|---|---|
| Gelatin | 0.2 g/m$^2$ |
| Second Layer: Low-Sensitive Red-Sensitive Layer | |
| Silver iodobromide emulsion spectrally sensitized with red sensitizers (*5, *4) (silver iodide: 3.5 mol %, mean grain size: 0.7 μm) | 0.15 g of Ag/m$^2$ |
| Gelatin | 1.0 g/m$^2$ |
| Cyan coupler (*3) | 0.30 g/m$^2$ |
| Discoloration inhibitor (*2) | 0.15 g/m$^2$ |
| Coupler solvent (*1) | 0.06 g/m$^2$ |
| Third Layer: High-Sensitive Red-Sensitive Layer | |
| Silver iodobromide emulsion spectrally sensitized with red sensitizers (*5, *4) (silver iodide: 8.0 mol %, mean grain size: 0.7 μm) | 0.10 g of Ag/m$^2$ |
| Gelatin | 0.50 g/m$^2$ |
| Cyan coupler (*3) | 0.10 g/m$^2$ |
| Discoloration inhibitor (*2) | 0.05 g/m$^2$ |
| Coupler solvent (*1) | 0.02 g/m$^2$ |
| Fourth Layer: Intermediate Layer | |
| Yellow colloidal silver | 0.02 g of Ag/m$^2$ |
| Gelatin | 1.00 g/m$^2$ |
| Color mixing inhibitor (*14) | 0.08 g/m$^2$ |
| Color mixing inhibitor solvent (*13) | 0.16 g/m$^2$ |
| Polymer latex (*6) | 0.40 g/m$^2$ |
| Fifth Layer: Low-Sensitive Green-Sensitive Layer | |
| Silver iodobromide emulsion spectrally sensitized with green sensitizer (*12) (silver iodide: 2.5 mol %, mean grain size: 0.4 μm) | 0.20 g of Ag/m$^2$ |
| Gelatin | 0.70 g/m$^2$ |
| Magenta coupler (*11) | 0.40 g/m$^2$ |
| Discoloration Inhibitor A (*10) | 0.05 g/m$^2$ |
| Discoloration Inhibitor B (*9) | 0.05 g/m$^2$ |
| Discoloration Inhibitor C (*8) | 0.02 g/m$^2$ |
| Coupler solvent (*7) | 0.60 g/m$^2$ |
| Sixth Layer: High-Sensitive Green-Sensitive Layer | |
| Silver iodobromide emulsion spectrally sensitized with green sensitizer (*12) (silver iodide: 3.5 mol %, mean grain size: 0.9 μm) | 0.20 g of Ag/m$^2$ |
| Gelatin | 0.70 g/m$^2$ |
| Matenta coupler (*11) | 0.40 g/m$^2$ |
| Discoloration Inhibitor A (*10) | 0.05 g/m$^2$ |
| Discoloration Inhibitor B (*9) | 0.05 g/m$^2$ |
| Discoloration Inhibitor C (*8) | 0.02 g/m$^2$ |
| Coupler solvent (*18) | 0.60 g/m$^2$ |
| Seventh Layer: Yellow Filter Layer | |
| Yellow colloidal silver | 0.20 g of Ag/m$^2$ |
| Gelatin | 1.00 g/m$^2$ |
| Color mixing inhibitor (*14) | 0.06 g/m$^2$ |
| Color mixing inhibitor solvent (*13) | 0.24 g/m$^2$ |
| Eighth Layer: Low-Sensitive Blue-Sensitive Layer | |
| Silver iodobromide emulsion spectrally sensitized with blue sensitizer (*16) (silver iodide: 2.5 mol %, mean grain size: 0.5 μm) | 0.15 g of Ag/m$^2$ |
| Gelatin | 0.50 g/m$^2$ |
| Yellow coupler (*15) | 0.20 g/m$^2$ |
| Coupler solvent (*18) | 0.05 g/m$^2$ |
| Ninth Layer: High-Sensitive Blue-Sensitive Layer | |
| Silver iodobromide emulsion spectrally sensitized with blue sensitizer (*16) (silver iodide: 2.5 mol %, mean grain size: 1.4 μm) | 0.20 g of Ag/m$^2$ |
| Yellow coupler (*15) | 0.20 g/m$^2$ |
| coupler solvent (*18) | 0.05 g/m$^2$ |
| Tenth Layer: Ultraviolet Absorbing Layer | |
| Gelatin | 1.50 g/m$^2$ |
| Ultraviolet absorbent (*19) | 1.0 g/m$^2$ |
| Ultraviolet absorbent solvent (*18) | 0.30 g/m$^2$ |
| Color mixing inhibitor (*17) | 0.08 g/m$^2$ |
| Eleventh Layer: Protective Layer | |

-continued

| | |
|---|---|
| Gelatin | 1.0 g/m$^2$ |

The compounds used in the preparation of Sample (L) were as follows:

(*1) Dioctyl phthalate
(*2) 2-(2-Hydroxy-3-sec-butyl-5-t-butylphenyl)benzotriazole
(*3) 2-[α-(2,4-Di-t-amylphenoxy)butanamido]-4,6-dichloro-5-ethylphenol
(*4) 5,5'-Dichloro-3,3'-di(3-sulfobutyl)-9-ethylthiacarbocyanine sodium salt
(*5) Triethylammonium-3-[2-{2-[3-(3-sulfopropyl)naphtho[1,2-d]thiazolin-2-ylidenemethyl]-1-butenyl}-3-naphtho[1,2,d]thiazolino]propanesulfonate
(*6) Polyethylacrylate
(*7) Trioctyl phosphate
(*8) 2,4-Di-t-hexylhydroquinone
(*9) Di(2-hydroxy-3-t-butyl-5-methylphenyl)methane
(*10) 3,3,3',3'-Tetramethyl-5,6,5',6'-tetrapropoxy-1,1'-bisspiroindan
(*11) 3-(2-Chloro-5-tetradecanamidoanilino)-1-(2,4,6-trichlorophenyl)-2-pyrazolin-5-one
(*12) 5,5'-Diphenyl-9-ethyl-3,3'-disulfopropyloxacarbocyanine sodium salt
(*13) o-Cresyl phosphate
(*14) 2,4-Di-t-octylhydroquinone
(*15) α-Pivaloyl-α-[(2,4-dioxo-1-benzyl-5-ethoxyhydantoin-3-yl)-2-chloro-5-(α-2,4-dioxo-t-amylphenoxy)butanamido]acetanilide
(*16) Triethylammonium 3-[2-(3-benzylrhodanin-5-ylidene)-3-benzoxazolinyl]propanesulfonate
(*17) 2,4-Di-sec-octylhydroquinone
(*18) Trinonyl phosphate
(*19) 5-Chloro-2-(2-hydroxy-3-t-butyl-5-t-octyl)phenylbenzotriazole Samples (M) to (V) were prepared in the same manner as for Sample (L) except for the following variations.

Sample (M):

The fifth and sixth layers each further contained 0.3 mol of Compound (II-3) per mol of the magenta coupler.

Sample (N):

The fifth and sixth layers each further contained 0.3 mol of Compound (II-24) per mol of the magenta coupler.

Sample (O):

The fifth and sixth layers each contained a silver chlorobromide emulsion (silver bromide: 70 mol%) to a silver coverage of 180 mg/m$^2$ in place of the respective silver iodobromide emulsion and 380 mg/m$^2$ of Compound (I-5) in place of the magenta coupler (*11).

Sample (P):

The same layer structure as Sample (O) except that the fifth and sixth layers each further contained 0.3 mol of Compound (II-1) per mol of the magenta coupler.

Sample (Q):

The same layer structure as Sample (O) except that the fifth and sixth layers each further contained 0.3 mol of Compound (II-3) per mol of the magenta coupler.

Sample (R):

The same layer structure as Sample (O) except that the fifth and sixth layers each further contained 0.3 mol of Compound (II-21) per mol of the magenta coupler.

Sample (S):

The same layer structure as Sample (O) except that the fifth and sixth layers each further contained 0.3 mol of Compound (II-24) per mol of the magenta coupler.

Sample (T):

The same layer structure as Sample (O) except that the fifth and sixth layers each further contained 0.3 mol of Compound (II-26) per mol of the magenta coupler.

Sample (U):

The same layer structure as Sample (O) except for replacing the magenta coupler in each of the fifth and sixth layers with the same molar amount of Compound (I-20).

Sample (V):

The same layer structure as Sample (U) except that the fifth and sixth layers each further contained 0.3 mol of Compound (II-3) per mol of the magenta coupler.

Each of the resulting Samples (L) to (V) was exposed to light through an optical wedge and subjected to color development according to the following procedures.

| Processing Step | Temperature | Time |
|---|---|---|
| First Development (black-and-white development) | 38° C. | 1 min 15 sec |
| Washing | 38° C. | 1 min 30 sec |
| Reversal Exposure | Above 100 lux | Above 1 sec |
| Color Development | 38° C. | 2 min 15 sec |
| Washing | 38° C. | 45 sec |
| Bleach-Fix | 38° C. | 2 min 00 sec |
| Washing | 38° C. | 2 min 15 sec |

First Developing Solution Formulation

| | |
|---|---|
| Pentasodium Nitrilo-N,N,N—trimethylene-phosphonate | 0.6 g |
| Pentasodium Diethylenetriaminepenta-acetate | 4.0 g |
| Potassium Sulfite | 30.0 g |
| Potassium Thiocyanate | 1.2 g |
| Potassium Carbonate | 35.0 g |
| Potassium Hydroquinonemonosulfonate | 25.0 g |
| Diethylene Glycol | 15.0 ml |
| 1-Phenyl-4-hydroxymethyl-4-methyl-3-pyrazolidone | 2.0 g |
| Potassium Bromide | 0.5 g |
| Potassium Iodide | 5.0 mg |
| Water to make | 1,000 ml |
| | pH: 9.70 |

Color Developing Solution Formulation

| | |
|---|---|
| Benzyl Alcohol | 15.0 ml |
| Diethylene Glycol | 12.0 ml |
| 3,6-Dithia-1,8-octanediol | 0.2 g |
| Pentasodium Nitrilo-N,N,N—trimethylene-phosphonate | 0.5 g |
| Pentasodium Diethylenetriaminepenta-acetate | 2.0 g |
| Sodium Sulfite | 2.0 g |
| Potassium Carbonate | 25.0 g |
| Hydroxylamine Sulfate | 3.0 g |
| N—Ethyl-N—(β-methanesulfonamidoethyl)-3-methyl-4-aminoaniline Sulfate | 5.0 g |
| Potassium Bromide | 0.5 g |
| Potassium Iodide | 1.0 mg |
| Water to make | 1,000 ml |
| | pH 10.40 |

Bleach-Fix Bath Formulation

| | |
|---|---|
| 2-Mercapto-1,3,4-triazole | 1.0 g |
| Disodium Ethylenediaminetetraacetate Dihydrate | 5.0 g |
| Ammonium (Ethylenediaminetetraacetato)-iron (III) Monohydrate | 80.0 g |
| Sodium Sulfite | 15.0 g |
| Sodium Thiosulfate (700 g/l) | 160.0 ml |
| Glacial Acetic Acid | 5.0 ml |
| Water to make | 1,000 ml |
| | pH: 6.50 |

Magenta and yellow densities of each of the thus processed Samples (L) to (V) were determined in the same manner as in Example 1 to obtain stain increases. The results obtained are shown in Table 4.

TABLE 4

| Sample No. | Coupler | Mercapto Compound | Stain Increase on Unexposed Area Magenta | Yellow | Remarks |
|---|---|---|---|---|---|
| (L) | (*d) | — | 0.10 | 0.36 | Comparison |
| (M) | (*d) | (II-3) | 0.09 | 0.31 | " |
| (N) | (*d) | (II-24) | 0.09 | 0.30 | " |
| (O) | (I-5) | — | 0.13 | 0.18 | " |
| (P) | (I-5) | (II-1) | 0.07 | 0.18 | Invention |
| (Q) | (I-5) | (II-3) | 0.06 | 0.17 | " |
| (R) | (I-5) | (II-21) | 0.06 | 0.20 | " |
| (S) | (I-5) | (II-24) | 0.06 | 0.18 | " |
| (T) | (I-5) | (II-26) | 0.05 | 0.17 | " |
| (U) | (I-20) | — | 0.15 | 0.18 | Comparison |
| (V) | (I-20) | (II-3) | 0.05 | 0.17 | Invention |

As can be seen from the results of Tables 1 to 4, the combination of a pyrazoloazole magenta coupler of formula (I) and a mercapto compound of formula (II) greatly reduces the increase of stain, particularly magenta stain. To the contrary, if in using Coupler (*d), that is, a 4-equivalent pyrazolone coupler as described in Japanese Patent Application (OPI) No. 21048/85, no substantial inhibitory effect on magenta stain can be produced, even though a slight effect on yellow stain is observed.

When the mercapto compound of the invention was incorporated in either one of the fifth and sixth layers, similar effects as above reported are obtained.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having provided thereon at least one silver halide emulsion layer having dispersed therein lipophilic fine particles containing a lipophilic pyrazoloazole coupler represented by formula (I)

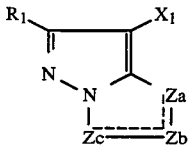

(I)

wherein $R_1$ represents a hydrogen atom or a substituent; $X_1$ represents a hydrogen atom or a group releasable upon coupling with an oxidation product of an aromatic primary amine developing agent; Za, Zb and Zc each represents a methine group, a substituted methine group, =N—, or —NH—; either one of the Za—Zb bond and Zb—Zc bond is a double bond, with the other being a single bond; and a carbon-carbon double bond as represented by Zb—Zc may be a part of an aromatic ring condensed with the N-containing ring; and $R_1$, $X_1$, or the substituted methine group as represented by Za, Zb or Zc may form a polymer;

and said lipophilic fine particles further contain at least one lipophilic mercapto compound represented by formula (II)

R—SH (II)

wherein R represents a substituted or unsubstituted alkyl group, a substituted or unsubstituted alkenyl group, or a substituted or unsubstituted aryl group, and said compound of formula (II) has a water solubility of not more than 1% by weight at 25° C.

2. A silver halide color photographic material as in claim 1, wherein said pyrazoloazole coupler is represented by formula (I-a), (I-b), (I-c), (I-d), (I-e) or (I-f)

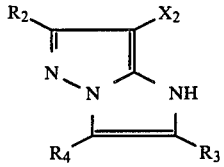
(I-a)

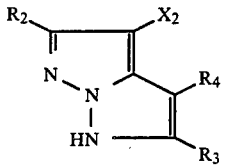
(I-b)

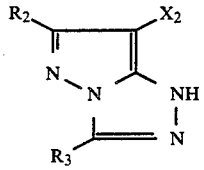
(I-c)

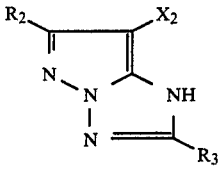
(I-d)

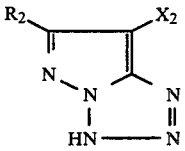
(I-e)

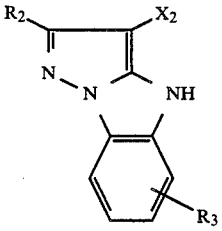
(I-f)

wherein $R_2$, $R_3$ and $R_4$ each represents a hydrogen atom, a halogen atom, an alkyl group, an aryl goup, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group; and $X_2$ represents a hydrogen atom, a halogen atom, a carboxyl group, or a group bonded to the coupling carbon atom via an oxygen atom, a nitrogen atom, or a sulfur atom, and being releasable upon coupling; or $R_2$, $R_3$, $R_4$ or $X_2$ is a divalent group at which a bis compound is formed; and when the moiety represented by formula (I-a), (I-b), (I-c), (I-d), (I-e) or (I-f) is contained in a vinyl monomer, $R_2$, $R_3$ or $R_4$ represents a single bond or a linking group via which the moiety of (I-a), (I-b), (I-c), (I-d), (I-e), or (I-f) and a vinyl group are bonded.

3. A silver halide color photographic material as in claim 2, wherein said pyrazoloazole coupler is represented by formula (I-a), (I-c) or (I-d).

4. A silver halide color photographic material as in claim 2, wherein said pyrazoloazole coupler is represented by formula (I-d).

5. A silver halide color photographic material as in claim 2, wherein said pyrazoloazole coupler is represented by formula (I-a), (I-c) or (I-d) wherein at least one of $R_2$ and $R_3$ is a substituted or unsubstituted branched chain alkyl group.

6. A silver halide color photographic material as in claim 5, wherein said substituted branched chain alkyl group is represented by

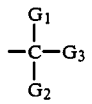

wherein $G_1$ is a hydrogen atom or a substituted or unsubstituted alkyl group, $G_2$ is a substituted or unsubstituted alkyl group and $G_3$ is a substituted alkyl group.

7. A silver halide color photographic material as in claim 6, wherein said substituted alkyl group represented by $G_3$ is a sulfonamidoalkyl group, a sulfonamidoarylalkyl group, or a sulfonylalkyl group.

8. A silver halide color photographic material as in claim 7, wherein said sulfonamidoalkyl group is a sulfonamidoarylsulfonamidoalkyl group.

9. A silver halide color photographic material as in claim 1, wherein said lipophilic fine particles further contain an alkyl phthalate ester, a phosphate ester or phenols each having a boiling point of 170° C. or higher at atmospheric pressure.

10. A silver halide color photographic material as in claim 1, wherein said lipophilic fine particles further contain a latex polymer.

11. A silver halide color photographic material as in claim 1, wherein R in formula (II) contains at least 8 carbon atoms.

12. A silver halide color photographic material as in claim 1, wherein said mercapto compound is present in an amount of from $5\times10^{-3}$ to 2 mols per mol of the coupler of formula (I).

13. A silver halide color photographic material as in claim 12, wherein said mercapto compound is present in an amount of from $2\times10^{-2}$ to 1 mol per mol of the coupler of formula (I).

* * * * *